US009920462B2

(12) United States Patent
Lee

(10) Patent No.: US 9,920,462 B2
(45) Date of Patent: Mar. 20, 2018

(54) BRAIDING MACHINE WITH MULTIPLE RINGS OF SPOOLS

(71) Applicant: NIKE, Inc., Beaverton, OR (US)

(72) Inventor: Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 175 days.

(21) Appl. No.: 14/821,125

(22) Filed: Aug. 7, 2015

(65) Prior Publication Data

US 2017/0037548 A1 Feb. 9, 2017

(51) Int. Cl.

| | |
|---|---|
| ***D04C 3/18*** | (2006.01) |
| ***D04C 1/06*** | (2006.01) |
| ***D04C 3/38*** | (2006.01) |
| ***D04C 3/40*** | (2006.01) |
| ***D04C 3/48*** | (2006.01) |
| ***D04C 3/22*** | (2006.01) |

(52) U.S. Cl.

CPC ..... *D04C 3/18* (2013.01); *D04C 1/06* (2013.01); *D04C 3/22* (2013.01); *D04C 3/38* (2013.01); *D04C 3/40* (2013.01); *D04C 3/48* (2013.01); *D10B 2501/043* (2013.01)

(58) Field of Classification Search

CPC ..... D10B 2501/043; D04C 1/06; D04C 1/18; D04C 1/22; D04C 1/38; D04C 1/48; D04C 1/40

USPC ..... 87/44, 37

See application file for complete search history.

(56) References Cited

U.S. PATENT DOCUMENTS

| | | | | |
|---|---|---|---|---|
| 165,941 A | | 7/1875 | Malhere | |
| 293,020 A | * | 2/1884 | Hedtmann et al. | D04C 3/00 87/37 |
| 329,739 A | | 11/1885 | Henkels | |
| 376,372 A | | 1/1888 | Dodge et al. | |
| 450,685 A | | 4/1891 | Struss | |
| 810,056 A | * | 1/1906 | Janssen | D04C 3/00 87/37 |
| 847,005 A | * | 3/1907 | Kirberg | D04C 1/06 87/41 |

(Continued)

FOREIGN PATENT DOCUMENTS

| | | | |
|---|---|---|---|
| DE | 726634 | C | 10/1942 |
| DE | 4306286 | A1 | 9/1993 |
| EP | 1486601 | A1 | 12/2004 |
| EP | 2657384 | A1 | 10/2013 |
| GB | 161552 | A | 12/1921 |
| GB | 477556 | A | 1/1938 |
| GB | 1196983 | A | 7/1970 |
| JP | H04174749 | A | 6/1992 |

(Continued)

OTHER PUBLICATIONS

International Search Report and Written Opinion dated Nov. 17, 2016 for International Patent Application No. PCT/US2016/045319, 13 pages.

(Continued)

*Primary Examiner* — Shaun R Hurley
*Assistant Examiner* — Bao-Thieu L Nguyen
(74) *Attorney, Agent, or Firm* — Shook, Hardy & Bacon L.L.P.

(57) ABSTRACT

A braiding machine including several rings for passing spools. The braiding machine may include an inner ring and an outer ring which may be comprised of rotor metals, and an intermediate ring that may be comprised of horn gears. Spools may pass along the inner and outer rings, and the horn gears in the intermediate ring may allow spools to be passed back and forth between the inner ring and the outer ring.

28 Claims, 25 Drawing Sheets

(56) References Cited

U.S. PATENT DOCUMENTS 894,022 A * 7/1908 Lepperhoff ..... D04C 3/20 87/37
920,994 A * 5/1909 Prante ..... D04C 3/00 87/30
936,356 A * 10/1909 Rahm ..... D04C 3/00 87/37
979,502 A * 12/1910 Janssen et al. ..... D04C 3/00 87/37
995,844 A 6/1911 Chausee et al.
1,117,330 A * 11/1914 Cobb ..... D04C 1/06 87/30
1,318,888 A 10/1919 Carpentier
1,379,478 A 5/1921 Schevitz et al.
1,527,344 A 2/1925 Bente et al.
1,538,160 A 5/1925 Bosebeck
1,554,325 A 9/1925 Bente
1,583,273 A 5/1926 Bosebeck
1,593,670 A * 7/1926 Petersen ..... D04C 1/12 87/42
1,622,021 A 3/1927 Birkin et al.
1,637,716 A 8/1927 Turck
1,885,676 A 11/1932 Blaisdell
1,887,643 A 11/1932 Huber
2,022,350 A 11/1935 Huber
2,091,215 A 8/1937 Price
2,188,640 A 1/1940 Bloch et al.
2,788,700 A * 4/1957 Crossley ..... D04C 3/12 87/50
2,879,687 A 3/1959 Leimbach et al.
2,936,670 A * 5/1960 Walter ..... D07B 7/14 156/148
2,941,440 A * 6/1960 Scanlon ..... D04C 3/00 87/50
2,960,905 A * 11/1960 Scanlon ..... D04C 3/18 87/55
3,282,757 A 11/1966 Brussee et al.
3,397,847 A 8/1968 Thaden et al.
3,426,804 A * 2/1969 Bluck ..... D04C 1/06 139/11
3,521,315 A 7/1970 Chatzimikes
3,541,247 A 11/1970 Moi et al.
3,586,058 A 6/1971 Ahrens et al.
3,714,862 A * 2/1973 Berger ..... D04C 1/08 87/33
3,943,361 A 3/1976 Miller
4,005,873 A 2/1977 Jacobsen et al.
4,275,638 A 6/1981 DeYoung
4,312,261 A * 1/1982 Florentine ..... D03D 41/004 87/33
4,323,925 A 4/1982 Abell et al.
4,351,889 A 9/1982 Sundberg
4,366,476 A 12/1982 Hicken
4,494,436 A 1/1985 Kruesi
4,519,290 A 5/1985 Inman et al.
4,591,155 A 5/1986 Adachi et al.
4,615,256 A * 10/1986 Fukuta ..... D03D 41/004 139/11
4,719,837 A 1/1988 McConnell et al.
4,847,063 A 7/1989 Smith et al.
4,848,745 A 7/1989 Bohannan et al.
4,857,124 A 8/1989 Shobert et al.
4,884,309 A 12/1989 Shafir et al.
4,885,973 A 12/1989 Spain et al.
4,909,127 A 3/1990 Skelton et al.
4,916,997 A 4/1990 Spain et al.
4,934,240 A 6/1990 Culp et al.
4,976,812 A 12/1990 McConnell et al.
4,992,313 A 2/1991 Shobert et al.
5,001,961 A 3/1991 Spain et al.
5,067,525 A * 11/1991 Tsuzuki ..... D04C 1/06 139/11
5,121,329 A 6/1992 Crump et al.
5,203,249 A 4/1993 Adams et al.
5,257,571 A 11/1993 Richardson
5,287,790 A 2/1994 Akiyama et al.
5,348,056 A 9/1994 Tsuzuki et al.
5,361,674 A 11/1994 Akiyama et al.
5,388,497 A 2/1995 Akiyama et al.
5,396,829 A * 3/1995 Akiyama ..... B29C 70/16 87/29
5,398,586 A 3/1995 Akiyama et al.
5,439,215 A 8/1995 Ratchford et al.
5,476,027 A 12/1995 Uchida et al.
5,601,522 A * 2/1997 Piramoon ..... B04B 5/0414 156/172
5,879,725 A 3/1999 Potter
5,885,622 A 3/1999 Daley et al.
5,915,030 A 6/1999 Viebach et al.
6,024,005 A 2/2000 Uozumi
6,029,375 A 2/2000 Borel
6,345,598 B1 2/2002 Bogdanovich et al.
6,495,227 B1 * 12/2002 Cahuzac ..... B29C 70/22 138/123
6,510,961 B1 1/2003 Head et al.
6,679,152 B1 1/2004 Head et al.
6,696,001 B1 2/2004 Quddus
6,741,728 B1 5/2004 Genest
7,004,967 B2 2/2006 Chouinard et al.
7,069,935 B2 7/2006 Bousfield et al.
7,079,916 B2 7/2006 Stimpson
7,093,527 B2 8/2006 Rapaport et al.
7,204,903 B2 4/2007 Yasui
7,252,028 B2 8/2007 Bechtold et al.
7,262,353 B2 8/2007 Bartholomew et al.
7,300,014 B2 11/2007 Allen
7,444,916 B2 11/2008 Hirukawa
7,566,376 B2 7/2009 Matsuoka
7,661,170 B2 2/2010 Goode et al.
7,793,576 B2 9/2010 Head et al.
7,815,141 B2 10/2010 Uozumi et al.
7,908,956 B2 3/2011 Dow et al.
7,938,853 B2 5/2011 Chouinard et al.
8,006,601 B2 8/2011 Inazawa et al.
8,061,253 B2 11/2011 Wybrow
8,192,572 B2 6/2012 Willey et al.
8,210,086 B2 7/2012 Head et al.
8,261,648 B1 9/2012 Marchand et al.
8,347,772 B2 * 1/2013 Dow ..... D04C 1/06 87/41
8,394,222 B2 3/2013 Rettig
8,511,214 B2 8/2013 Gries
8,578,534 B2 11/2013 Langvin et al.
8,651,007 B2 * 2/2014 Adams ..... A61F 2/90 87/11
8,690,962 B2 4/2014 Dignam et al.
8,757,038 B2 6/2014 Siegismund
8,770,081 B2 7/2014 David et al.
8,789,452 B1 7/2014 Janardhan et al.
8,794,118 B2 8/2014 Dow et al.
9,144,284 B2 * 9/2015 Chung ..... A45D 7/00
9,181,642 B2 * 11/2015 Cahuzac ..... D04C 3/00
2001/0026740 A1 10/2001 Yamanishi
2002/0020283 A1 * 2/2002 Uchida ..... B21F 27/12 87/11
2002/0160068 A1 10/2002 Nakamura
2004/0200014 A1 10/2004 Pons
2004/0237760 A1 12/2004 Shimizu
2005/0039769 A1 2/2005 Bousfied et al.
2005/0178026 A1 8/2005 Friton
2008/0189194 A1 8/2008 Bentvelzen
2009/0193961 A1 * 8/2009 Jensen ..... B29C 53/564 87/8
2009/0306762 A1 12/2009 McCullagh et al.
2011/0232008 A1 9/2011 Crisp
2013/0239790 A1 9/2013 Thompson et al.
2013/0258085 A1 10/2013 Leedy et al.
2013/0269159 A1 10/2013 Robitaille et al.
2013/0304232 A1 * 11/2013 Gries ..... D04C 1/06 623/23.71
2013/0305465 A1 * 11/2013 Siegismund ..... A43B 9/12 12/146 C
2013/0305911 A1 11/2013 Masson et al.

(56) References Cited

U.S. PATENT DOCUMENTS

| | | | | |
|---|---|---|---|---|
| 2014/0088688 | A1 | 3/2014 | Lilburn et al. | |
| 2014/0182170 | A1 | 7/2014 | Wawrousek et al. | |
| 2014/0182447 | A1 | 7/2014 | Kang et al. | |
| 2014/0230634 | A1* | 8/2014 | Nakai | D04C 1/06 87/8 |
| 2014/0283671 | A1* | 9/2014 | Head | D04C 1/06 87/8 |
| 2014/0373389 | A1 | 12/2014 | Bruce | |
| 2014/0377488 | A1 | 12/2014 | Jamison | |
| 2015/0007451 | A1 | 1/2015 | Bruce | |
| 2015/0040746 | A1* | 2/2015 | Kirth | D04C 3/40 87/6 |
| 2015/0045831 | A1* | 2/2015 | Allen | A61F 2/0811 606/228 |
| 2015/0299916 | A1* | 10/2015 | Reinisch | D04C 3/46 87/3 |
| 2016/0076178 | A1* | 3/2016 | Head | D04C 3/40 87/32 |
| 2016/0158769 | A1 | 6/2016 | Hornek et al. | |
| 2016/0168769 | A1* | 6/2016 | McDonnell | D04C 1/06 87/9 |
| 2016/0289873 | A1* | 10/2016 | Head | D03D 1/00 |
| 2017/0037548 | A1 | 2/2017 | Lee | |

FOREIGN PATENT DOCUMENTS

| | | | |
|---|---|---|---|
| JP | H0995844 | A | 4/1997 |
| JP | 10-158965 | A | 6/1998 |
| JP | 2008-240187 | A | 10/2008 |
| JP | 2013147760 | A | 8/2013 |
| KR | 2002-0038168 | A | 5/2002 |
| TW | M305221 | U | 1/2007 |
| TW | M447894 | U | 3/2013 |
| TW | 201328624 | A | 7/2013 |
| TW | M473088 | U | 3/2014 |
| TW | M487651 | U | 10/2014 |
| WO | 0153583 | A1 | 7/2001 |
| WO | 2009000371 | A1 | 12/2008 |
| WO | 2011111564 | A1 | 9/2011 |

OTHER PUBLICATIONS

Branscomb et al. "New Directions in Braiding", Journal of Engineered Fibers and Fabrics, http://www.jeffjournal.org vol. 8, Issue 2, 2013, pp. 11-24.

Anonymous: "3D print shoe last", styleforum, Feb. 19, 2014 (Feb. 19, 2014), pp. 1-4, XP055241611, Retrieved from the Internet on Jan. 14, 2016: URL:http://www.styleforum.net/t/137783/3dprint-shoe-last.

Ricardo Bilton: "How 3D body scanning will help you find a suit that actually fits", May 2, 2013 (May 2, 2013), XP055241783, URL:http://venturebeat.com/2013/05/02/how-3d-body-scanning-will-help-you-find-a-suit-that-actually-its/, Retrieved on Jan. 15, 2016.

International Search Report with Written Opinion dated Jan. 27, 2016 in International Patent Application No. PCT/US2015/055884, 14 pages.

International Search Report and Written Opinion dated Jan. 19, 2016 in PCT Application No. PCT/US2015/055625, 10 pages.

International Search Report and Written Opinion dated Sep. 27, 2016 for International Patent Application No. PCT/US2016/034097, 13 pages.

International Search Report and Written Opinion dated Nov. 11, 2016 in International Patent Application No. PCT/US2016/034102, 19 pages.

International Search Report and Written Opinion dated Nov. 14, 2016 for International Patent Application No. PCT/US2016/034104, 19 pages.

Notice of Allowance dated Jun. 21, 2017 in U.S. Appl. No. 14/565,682, 7 pages.

International Preliminary Report on Patentability dated Jun. 22, 2017 in International Patent Application No. PCT/US2015/055625, 5 pages.

International Preliminary Report on Patentability dated Jun. 22, 2017 in International Patent Application No. PCT/US2015/055884, 4 pages.

Non-Final Office Action dated Aug. 23, 2017 in U.S. Appl. No. 14/565,582, 9 pages.

Notice of Allowance dated Sep. 19, 2017 in U.S. Appl. No. 14/565,682, 7 pages.

Non-Final Office Action dated Oct. 6, 2017 in U.S. Appl. No. 14/721,314, 8 pages.

International Preliminary Report on Patentability dated Dec. 7, 2017 in International Patent Application No. PCTUS2016034102, 13 pages.

International Preliminary Report on Patentability dated Dec. 7, 2017 in International Patent Application No. PCTUS2016034104, 13 pages.

International Preliminary Report on Patentability dated Dec. 7, 2017 in International Patent Application No. PCTUS2016034097, 9 pages.

* cited by examiner

BRAIDING MACHINE WITH MULTIPLE RINGS OF SPOOLS

BACKGROUND

The present embodiments relate generally to braiding machines. Braiding machines are used to form braided textiles and to over-braid composite parts.

Braiding machines may form structures with various kinds of braiding patterns. Braided patterns are formed by intertwining three or more tensile strands (e.g., thread). The strands may be generally tensioned along the braiding direction.

SUMMARY

In one aspect, a braiding machine includes a support structure and a spool system. The spool system includes a first set of spool moving elements arranged in a first ring on the support structure, a second set of spool moving elements arranged in a second ring on the support structure and a third set of spool moving elements arranged in a third ring on the support structure. The spool system also includes a spool with thread, the spool being mounted to a carrier element. The spool mounted to the carrier element can be passed between the first set of spool moving elements and the second set of spool moving elements and the spool mounted to the carrier element can be passed between the third set of spool moving elements and the second set of spool moving elements.

In another aspect, a braiding machine includes a support structure and a spool system. The spool system includes a set of rotor metals arranged in a first ring on the support structure, a set of horn gears arranged in a second ring on the support structure and a spool with thread, the spool being mounted to a carrier element. The spool mounted to the carrier element can be passed between the set of rotor metals in the first ring and the set of horn gears in the second ring.

In another aspect, a braiding machine includes a support structure and a spool system. The spool system includes a first set of rotor metals arranged in an inner ring on the support structure, a set of horn gears arranged in an intermediate ring on the support structure, a second set of rotor metals arranged in an outer ring on the support structure and a spool with thread. The spool is mounted to a carrier element. The spool mounted to the carrier element can be passed between the first set of rotor metals and the set of horn gears and wherein the spool mounted to the carrier element can be passed between the second set of rotor metals and the set of horn gears.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
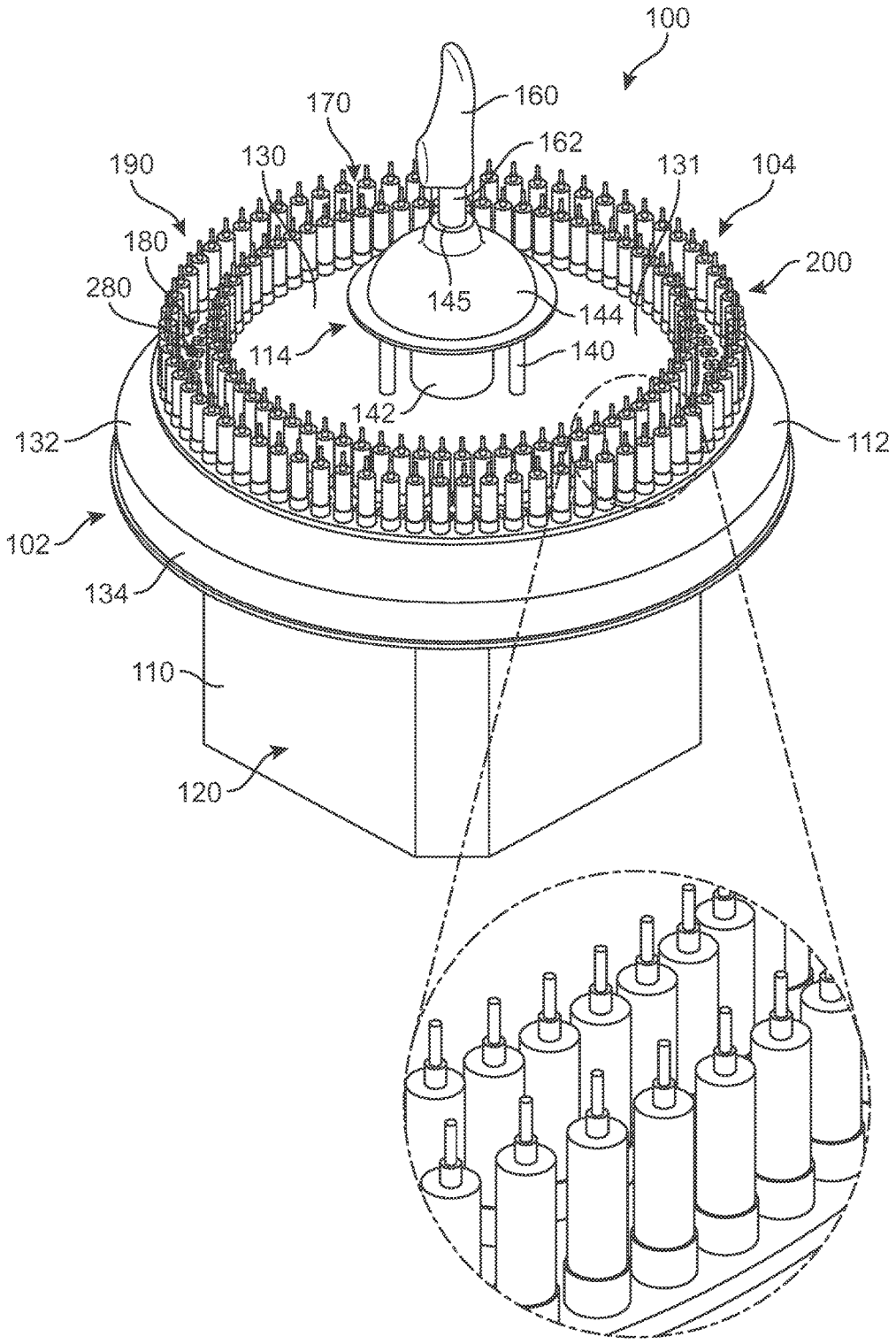
FIG. 1 is a schematic isometric view of an embodiment of a braiding machine.

The detailed description and the claims may make reference to various kinds of tensile elements, braided structures, braided configurations, braided patterns, and braiding machines.

As used herein, the term "tensile element" refers to any kinds of threads, yarns, strings, filaments, fibers, wires, cables as well as possibly other kinds of tensile elements described below or known in the art. As used herein, tensile elements may describe generally elongated materials with lengths much greater than their corresponding diameters. In some embodiments, tensile elements may be approximately one-dimensional elements. In some other embodiments, tensile elements may be approximately two-dimensional (e.g., with thicknesses much less than their lengths and widths). Tensile elements may be joined to form braided structures. A "braided structure" may be any structure formed by intertwining three or more tensile elements together. Braided structures could take the form of braided cords, ropes, or strands. Alternatively, braided structures may be configured as two-dimensional structures (e.g., flat braids) or three-dimensional structures (e.g., braided tubes) such as with lengths and width (or diameter) significantly greater than their thicknesses.

A braided structure may be formed in a variety of different configurations. Examples of braided configurations include, but are not limited to, the braiding density of the braided structure, the braid tension(s), the geometry of the structure (e.g., formed as a tube, an article, etc.), the properties of individual tensile elements (e.g., materials, cross-sectional geometry, elasticity, tensile strength, etc.) as well as other features of the braided structure. One specific feature of a braided configuration may be the braid geometry, or braid pattern, formed throughout the entirety of the braided configuration or within one or more regions of the braided structure. As used herein, the term "braid pattern" refers to the local arrangement of tensile strands in a region of the braided structure. Braid patterns can vary widely and may differ in one or more of the following characteristics: the orientations of one or more groups of tensile elements (or strands), the geometry of spaces or openings formed between braided tensile elements, the crossing patterns between various strands as well as possibly other characteristics. Some braided patterns include lace-braided or jacquard patterns, such as Chantilly, Bucks Point, and Torchon. Other patterns include biaxial diamond braids, biaxial regular braids, as well as various kinds of triaxial braids.

Braided structures may be formed using braiding machines. As used herein, a "braiding machine" is any machine capable of automatically intertwining three or more tensile elements to form a braided structure. Braiding machines may generally include spools, or bobbins, that are moved or passed along various paths on the machine. As the spools are passed around, tensile strands extending from the spools toward a center of the machine may converge at a "braiding point" or braiding area. Braiding machines may be characterized according to various features including spool control and spool orientation. In some braiding machines, spools may be independently controlled so that each spool can travel on a variable path throughout the braiding process, hereafter referred to as "independent spool control." Other braiding machines, however, may lack independent spool control, so that each spool is constrained to travel along a fixed path around the machine. Additionally, in some braiding machines, the central axes of each spool point in a common direction so that the spool axes are all parallel, hereby referred to as an "axial configuration." In other braiding machines, the central axis of each spool is oriented toward the braiding point (e.g., radially inward from the perimeter of the machine toward the braiding point), hereby referred to as a "radial configuration."

One type of braiding machine that may be utilized is a radial braiding machine or radial braider. A radial braiding machine may lack independent spool control and may therefore be configured with spools that pass in fixed paths around the perimeter of the machine. In some cases, a radial braiding machine may include spools arranged in a radial configuration. For purposes of clarity, the detailed description and the claims may use the term "radial braiding machine" to refer to any braiding machine that lacks independent spool control. The present embodiments could make use of any of the machines, devices, components, parts, mechanisms, and/or processes related to a radial braiding machine as disclosed in Dow et al., U.S. Pat. No. 7,908,956, issued Mar. 22, 2011, and titled "Machine for Alternating Tubular and Flat Braid Sections," and as disclosed in Richardson, U.S. Pat. No. 5,257,571, issued Nov. 2, 1993, and titled "Maypole Braider Having a Three Under and Three Over Braiding path," with each application being herein incorporated by reference in its entirety. These applications may be hereafter referred to as the "Radial Braiding Machine" applications.

Another type of braiding machine that may be utilized is a lace braiding machine, also known as a Jacquard or Torchon braiding machine. In a lace braiding machine, the spools may have independent spool control. Some lace braiding machines may also have axially arranged spools. The use of independent spool control may allow for the creation of braided structures, such as lace braids, that have an open and complex topology, and may include various kinds of stitches used in forming intricate braiding patterns. For purposes of clarity, the detailed description and the claims may use the term "lace braiding machine" to refer to any braiding machine that has independent spool control. The present embodiments could make use of any of the machines, devices, components, parts, mechanisms, and/or processes related to a lace braiding machine as disclosed in Ichikawa, EP Patent Number 1486601, published on Dec. 15, 2004, and titled "Torchon Lace Machine," and as disclosed in Malhere, U.S. Pat. No. 165,941, issued Jul. 27, 1875, and titled "Lace-Machine," with each application being herein incorporated by reference in its entirety. These applications may be hereafter referred to as the "Lace Braiding Machine" applications.

Spools may move in different ways according to the operation of a braiding machine. In operation, spools that are moved along a constant path of a braiding machine may be said to undergo "Non-Jacquard motions," while spools that move along variable paths of a braiding machine are said to undergo "Jacquard motions." Thus, as used herein, a lace braiding machine provides means for moving spools in Jacquard motions, while a radial braiding machine can only move spools in Non-Jacquard motions.

The embodiments may also utilize any of the machines, devices, components, parts, mechanisms, and/or processes related to a braiding machine as disclosed in Lee, U.S. Patent Publication Number 2016-0345676, published Dec. 12, 2016, (U.S. patent application Ser. No. 14/721,563, filed May 26, 2015), titled "Braiding Machine and Method of Forming an Article Incorporating Braiding Machine," the entirety of which is herein incorporated by reference and hereafter referred to as the "Fixed Last Braiding" application. The embodiments may also utilize any of the machines, devices, components, parts, mechanisms, and/or processes related to a lace braiding machine as disclosed in Lee, U.S. Patent Publication Number 2016-0345677, published Dec. 1, 2016 (now U.S. patent application Ser. No. 14/721,614, filed May 26, 2015), titled "Method of Forming a Braided Component Incorporating a Moving Object," the entirety of which is herein incorporated by reference and hereafter referred to as the "Moving Last Braiding" application.

Figure 2:
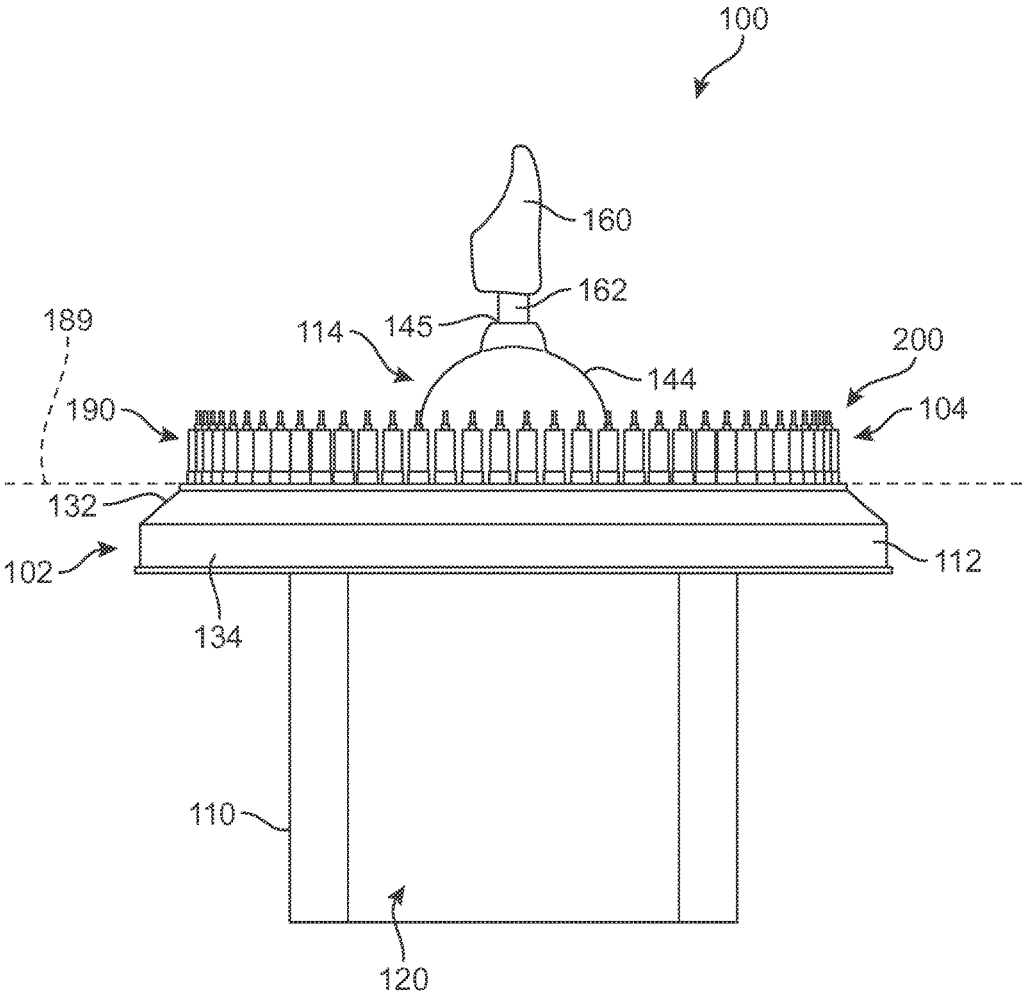
FIG. 2 is a schematic side view of an embodiment of a braiding machine.

FIG. 1 illustrates an isometric view of an embodiment of a braiding machine 100. FIG. 2 illustrates a side view of an embodiment of braiding machine 100. In some embodiments, braiding machine 100 may include a support structure 102 and a spool system 104. Support structure 102 may be further comprised of a base portion 110, a top portion 112 and a central fixture 114.

In some embodiments, base portion 110 may comprise one or more walls 120 of material. In the exemplary embodiment of FIGS. 1-2, base portion 110 is comprised of four walls 120 that form an approximately rectangular base for braiding machine 100. However, in other embodiments, base portion 110 could comprise any other number of walls arranged in any other geometry. In this embodiment, base portion 110 acts to support top portion 112 and may therefore be formed in a manner so as to support the weight of top portion 112, as well as central fixture 114 and spool system 104, which are attached to top portion 112.

In some embodiments, top portion 112 may comprise a top surface 130, which may further include a central surface portion 131 and a peripheral surface portion 132. In some embodiments, top portion 112 may also include a sidewall surface 134 that is proximate peripheral surface portion 132. In the exemplary embodiment, top portion 112 has an approximately circular geometry, though in other embodiments, top portion 112 could have any other shape. Moreover, in the exemplary embodiment, top portion 112 is seen to have an approximate diameter that is larger than a width of base portion 110, so that top portion 112 extends beyond base portion 110 in one or more horizontal directions.

Braiding machine 100 can include provisions for supporting a last. In some embodiments, braiding machine 100 may include central fixture 114 in order to support a last, as discussed in further detail below. In the exemplary embodiment, central fixture 114 includes one or more legs 140 and a central base 142. Central fixture 114 also includes a dome portion 144. In other embodiments, however, central fixture 114 could have any other geometry.

Some embodiments of a braiding machine may include a last. In some embodiments, a braiding machine can include a fixed last that is stationary with respect to the braiding machine. In other embodiments, a braiding machine can be operated with one or more moving lasts that pass through the braiding machine and corresponding braiding point.

The exemplary embodiment of FIGS. 1-2 includes a last member 160, which is secured to central fixture 114. Last member 160 could have any size, geometry, and/or orientation. In the exemplary embodiment, last member 160 comprises a three-dimensional contoured last in the shape of a foot (i.e., last member 160 is a footwear last). However, other embodiments could utilize lasts having any other geometry that are configured for forming braided articles with any other shape.

Last member 160 could be attached to central fixture 114 in any manner. In some embodiments, a post 162 could be used to hold last member 160 in place on central fixture 114. For example, post 162 could be permanently or temporarily secured at one end within an opening 145 of dome portion 144. Last member 160 could then be screwed onto, or otherwise fastened to, a furthest projecting end of post 162.

For purposes of clarity, the exemplary embodiment depicts a last member 160 having the geometry of a footwear last or foot. However, in some other embodiments, any other kind of mandrel, last, or partial last could be used with a braiding machine. As an example, other embodiments could use one or more partial lasts (e.g., a last with the geometry of a only a forefoot or of only a heel) as disclosed in the Fixed Last Braiding application.

Components of the support structure could be comprised of any materials. Exemplary materials that could be used include any materials with metals or metal alloys including, but not limited to, steel, iron, steel alloys, and/or iron alloys.

Figure 3:
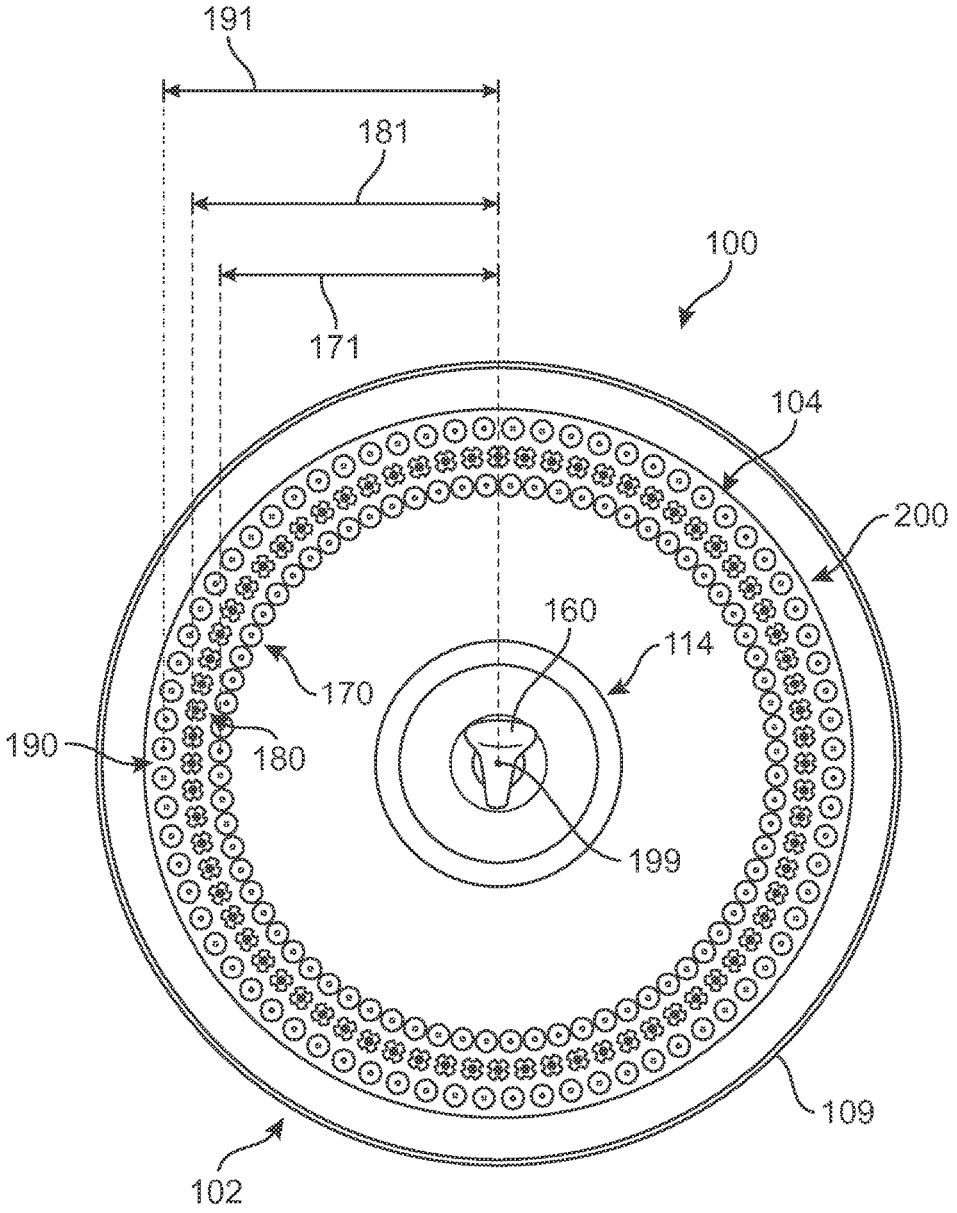
FIG. 3 is a top down view of an embodiment of a braiding machine.
Figure 4:
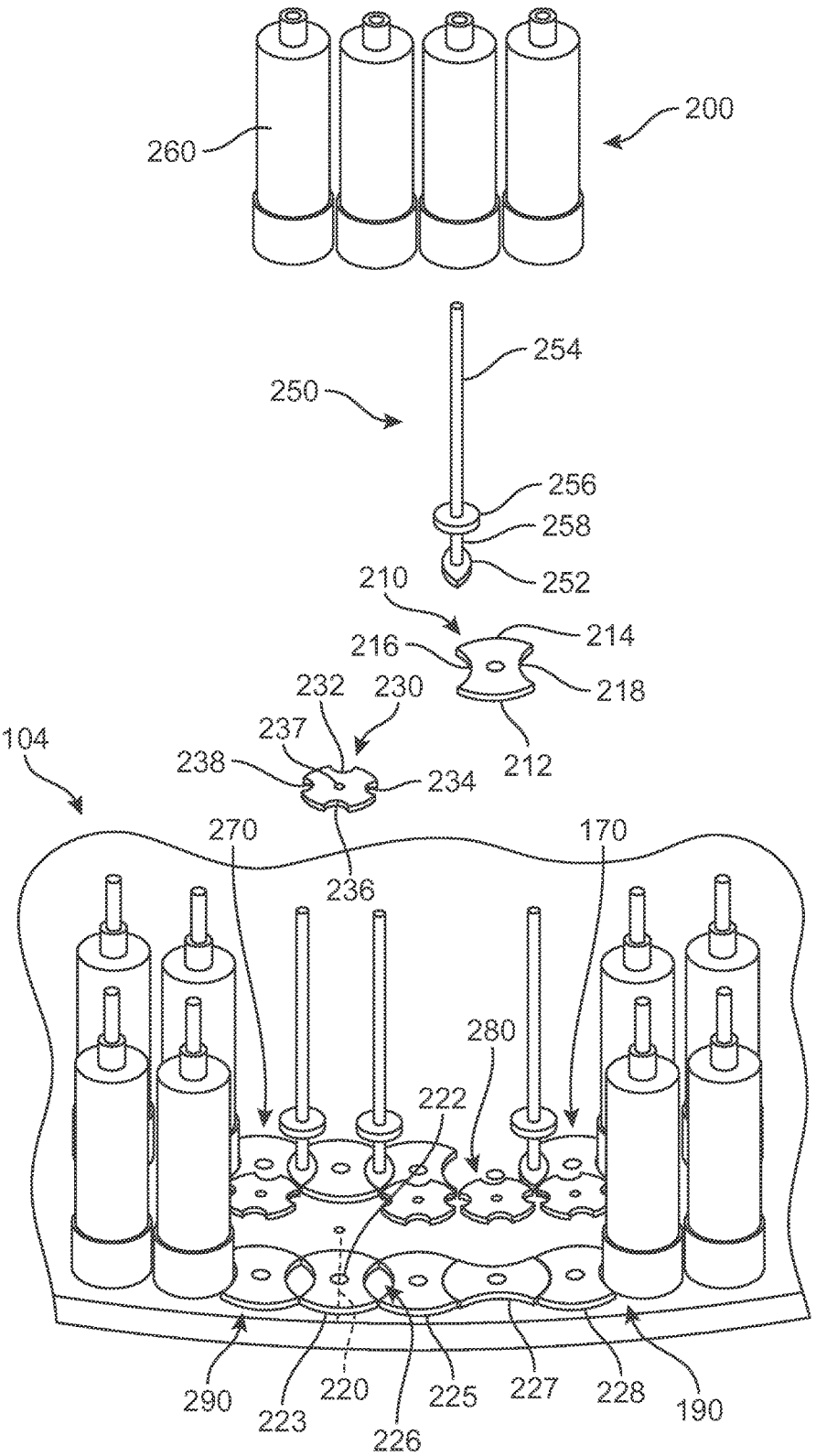
FIG. 4 is a partial exploded isometric view of a section of the braiding machine of FIG. 1.

FIG. 3 is a top down view of an embodiment of braiding machine 100. FIG. 4 illustrates a partially exploded view of some components of spool system 104. For purposes of clarity, some components have been removed and are not visible in FIG. 4. Referring now to FIGS. 1-4, spool system 104 provides a means of intertwining threads from various spools of spool system 104.

Spool system 104 may be comprised of various components for passing or moving spools along the surface of braiding machine 100. In some embodiments, spool system 104 may include one or more spool-moving elements. As used herein, the term "spool-moving element" refers to any provision or component that may be used to move or pass a spool along a path on the surface of a braiding machine. Exemplary spool-moving elements include, but are not limited to, rotor metals, horn gears as well as possibly other kinds of gears or elements. The exemplary embodiments shown in the figures make use of both rotor metals and horn hears that rotate in place and facilitate passing carrier elements to which spools are mounted around in paths on the surface of the braiding machines.

In some embodiments, spool system 104 may include one or more rotor metals. Rotor metals may be used in moving spools along a track or path in a lace braiding machine, such as a Torchon braiding machine.

An exemplary rotor metal 210 is depicted in FIG. 4. Rotor metal 210 includes two opposing convex sides and two opposing concave sides. Specifically, rotor metal 210 includes first convex side 212, second convex side 214, first concave side 216 and second concave side 218. In some embodiments, all of the rotor metals comprising braiding machine 100 may have a similar size and geometry. In some other embodiments, however, rotor metals located along an inner ring (to be described below) may be slightly smaller in size than rotor metals located along an outer ring.

Rotor metals may rotate about an axis extending through a central opening. For example, a rotor metal 223 is configured to rotate about an axis 220 that extends through central opening 222. In some embodiments, central opening 222 may receive an axle or fastener (not shown) about which rotor metal 223 may rotate. Moreover, the rotor metals are positioned such that gaps may be formed between concave sides. For example, a gap 226 is formed between the concave sides of rotor metal 223 and an adjacent rotor metal 225.

As an individual rotor metal rotates, the convex portions of the rotating rotor metal pass by the concave sides of adjacent rotor metals without interference. For example, rotor metal 227 is shown in a rotated position such that the convex sides of rotor metal 227 fit into the concave sides of rotor metal 225 and rotor metal 228. In this way, each rotor metal can rotate in place so long as the opposing rotor metals are stationary during that rotation, in order to prevent interference (e.g., contact) between the convex sides of two adjacent rotor metals.

Spool system 104 may also include one or more horn gears. Horn gears may be used in moving spools along a track or path in a radial braiding machine. An exemplary horn gear 230 is depicted in FIG. 4. Horn gear 230 may have a rounded geometry, and may further include one or more notches or slots. In the exemplary embodiment, horn gear 230 includes a first slot 232, a second slot 234, a third slot 236 and a fourth slot 238. Horn gear 230 may further include a central opening 237 through which an axle or fastener can be inserted, and about which horn gear 230 may rotate. In contrast to the rotor metals that may be approximately symmetric about rotations of 180 degrees (since rotations of 90 degrees changes between a concave and convex side), horn gears may be approximately symmetric about 90 degrees.

Spool system 104 may include additional components, such as one or more carrier elements, which are configured to carry spools. One exemplary carrier element 250 is depicted in FIG. 4. In this exemplary embodiment, carrier element 250 includes a rotor engaging portion 252 and a rod portion 254. Rotor engaging portion 252 may be shaped to fit into a gap formed between the concave sides of two adjacent rotor metals (e.g., gap 226). In some embodiments, rotor engaging portion 252 has an approximately elliptic or elongated geometry. Alternatively, in other embodiments, rotor engaging portion 252 could have any other shape that could be accepted by, and passed between, adjacent rotor metals. Rod portion 254 may receive a corresponding spool. Optionally, carrier element 250 can include a flange portion 256 where a spool can sit, thereby creating a small intermediate rod portion 258 where carrier element 250 can be engaged by the slot of a horn gear. Of course, in other embodiments, carrier element 250 may include any other provisions for engaging rotor metals and/or horn gears, as well as for receiving spools. In at least some embodiments, it is contemplated that one or more horn gears may be raised slightly above one or more rotor metals such that the horn gears may engage a portion of a carrier element that is higher than a portion of the carrier element engaged by the rotor metals.

Spool system 104 may include additional components for controlling the motion of one or more rotor metals and/or horn gears. For example, embodiments can include one or more gear assemblies that act to drive the rotor metals and/or horn gears. Exemplary gear assemblies for controlling the rotation of rotor metals are disclosed in the Lace Braiding Machine applications, while gear assemblies for controlling the rotation of horn gears are disclosed in the Radial Braid Machine applications. It will be understood that still other gear assemblies are possible and one skilled in the art may choose types of gears and a particular arrangement of gears to achieve desired rotation speeds or other desired features for the rotor metals and horn gears of spool system 104.

Spool system 104 may also include one or more spools, which may alternatively be referred to as "spindles," "bobbins," and/or "reels." Each spool may be placed on a carrier element, thereby allowing the spool to be passed between adjacent rotor metals and/or horn gears. As seen in FIGS. 1-3, spool system 104 includes plurality of spools 200 that are mounted on associated carrier elements and which may be passed around the surface of braiding machine 100.

As seen in FIG. 4, plurality of spools 200 includes a spool 260. Spool 260 may be any kind of spool, spindle, bobbin, or reel that holds a tensile element for a braiding machine. As used here, the term "tensile element" refers to any kind of element that may be braided, knitted, woven, or otherwise intertwined. Such tensile elements, could include, but are not limited to, threads, yarns, strings, wires, cables as well as possibly other kinds of tensile elements. As used herein, tensile elements may describe generally elongated materials with lengths much greater than corresponding diameters. In other words, tensile elements may be approximately one-dimensional elements, in contrast to sheets or layers of textile materials that may generally be approximately two-dimensional (e.g., with thicknesses much less than their lengths and widths). The exemplary embodiment illustrates the use of various kinds of threads; however, it will be understood that any other kinds of tensile elements that are compatible with a braiding device could be used in other embodiments.

The tensile elements, such as thread, carried on spools of a braiding machine (e.g., braiding machine 100) may be formed of different materials. The properties that a particular type of thread will impart to an area of a braided component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the thread selected for formation of a braided component may affect the properties of the braided component. For example, a thread may be a monofilament thread or a multifilament thread. The thread may also include separate filaments that are each formed of different materials. In addition, the thread may include filaments that are each formed of two or more different materials, such as a bi-component thread with filaments having a sheath-core configuration or two halves formed of different materials.

The components of spool system 104 may be organized into three rings, including an inner ring 170, an intermediate ring 180 and an outer ring 190 (see FIG. 1 and FIG. 3). Each ring may be comprised of a set of components for passing spools along the ring. For example, inner ring 170 may be comprised of a first set of rotor metals 270 (see FIG. 4) arranged in a closed track or path. Intermediate ring 180 may be comprised of a set of horn gears 280 arranged in a closed track or path. Outer ring 190 may be comprised of a second set of rotor metals 290 (see FIG. 4) arranged in a closed track or path.

As best seen in FIG. 3, in the exemplary embodiment, inner ring 170, intermediate ring 180, and outer ring 190 may have a concentric arrangement. Specifically, inner ring 170 is concentrically arranged within intermediate ring 180. Also, intermediate ring 180 is concentrically arranged within outer ring 190. In other words, inner ring 170, intermediate ring 180, and outer ring 190 are arranged around a common center 199, and have different diameters. Specifically, inner ring 170 has a first radius 171, intermediate ring 180 has a second radius 181 and outer ring 190 has a third radius 191. As seen in FIG. 3, first radius 171 is less than second radius 181. Also, second radius 181 is less than third radius 191. Thus, inner ring 170 is seen to be closer to central fixture 114 than intermediate ring 180 and outer ring 190. Outer ring 190 is also seen to be closer to outer perimeter 109 of support structure 102.

It may be appreciated that rotor metals may generally not be visible in the isometric views of FIGS. 1, 2 and 3, as the rotor metals may be obscured by the presence of plurality of spools 200 placed on inner ring 170 and outer ring 190. However, as clearly illustrated in FIG. 4, each spool and carrier element in inner ring 170 or outer ring 190 may be held between two adjacent rotor metals.

Although each ring has a different diameter, the components of each ring may be arranged such that rotor metals of one ring are proximate horn gears of another ring. For example, in FIG. 4, first set of rotor metals 270 from inner ring 170 are proximate set of horn gears 280. Likewise, second set of rotor metals 290 from outer ring 190 are proximate set of horn gears 280. Specifically, each rotor metal of first set of rotor metals 270 is substantially close enough to at least one horn gear of set of horn gears 280 to allow a spool (mounted on a carrier element) to be passed between the rotor metal and the horn gear. In a similar manner, each rotor metal of second set of rotor metals 290 is substantially close enough to at least one horn gear of set of horn gears 280 to allow a spool (mounted on a carrier element) to be passed between the rotor metal and the horn gear.

Figure 5:
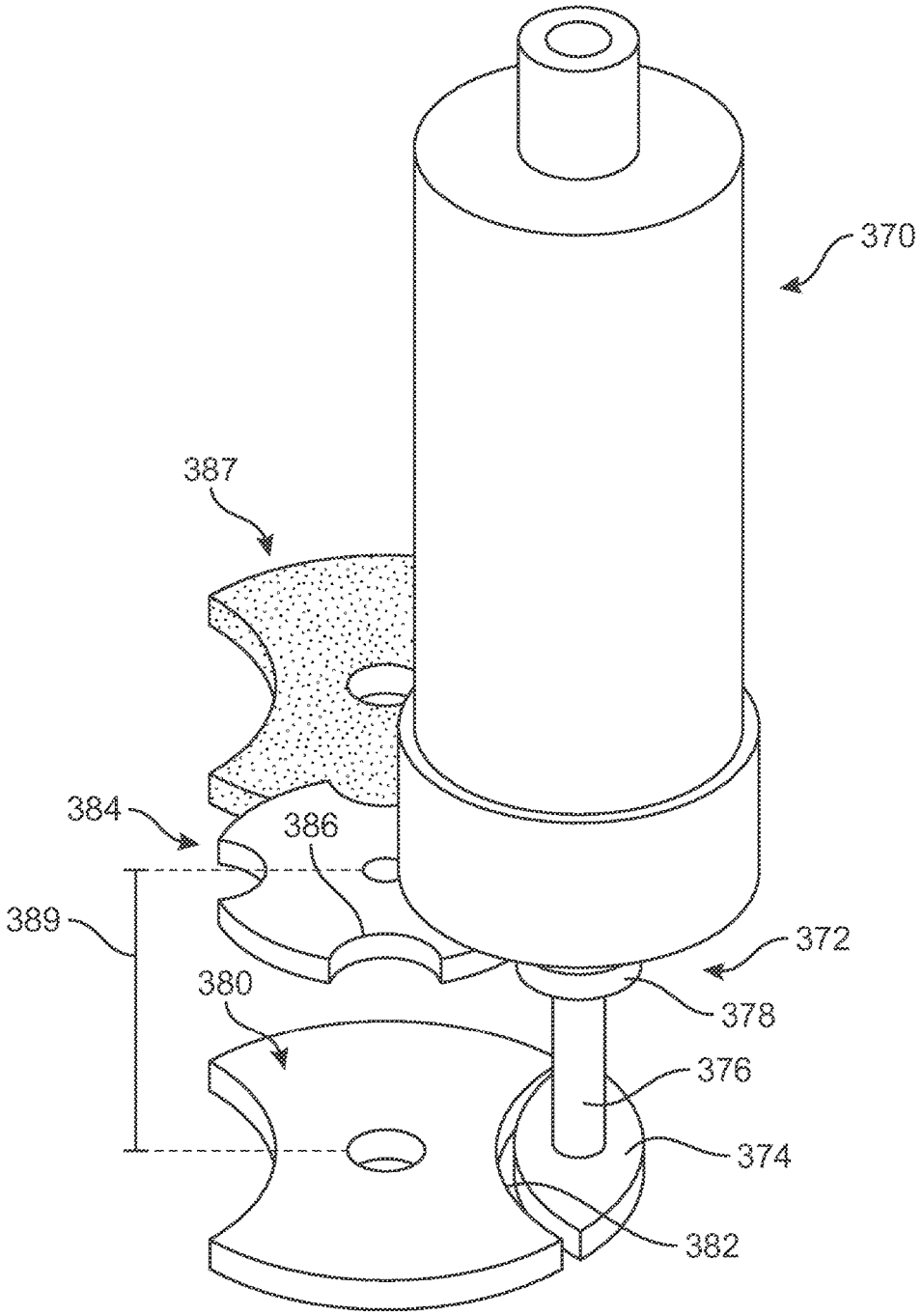
FIG. 5 is a schematic isometric view of several components of a braiding machine.
Figure 6:
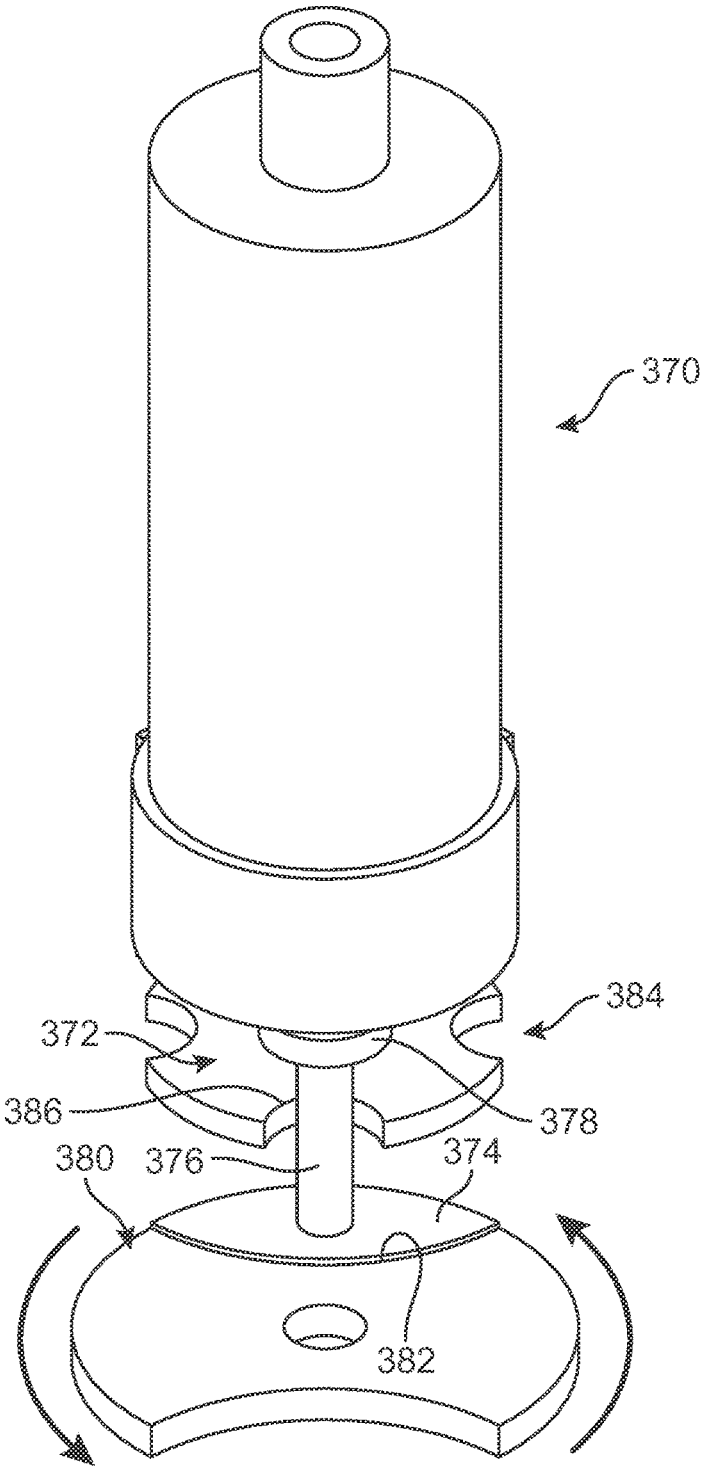
FIG. 6 is a schematic isometric view of several components of a braiding machine.
Figure 7:
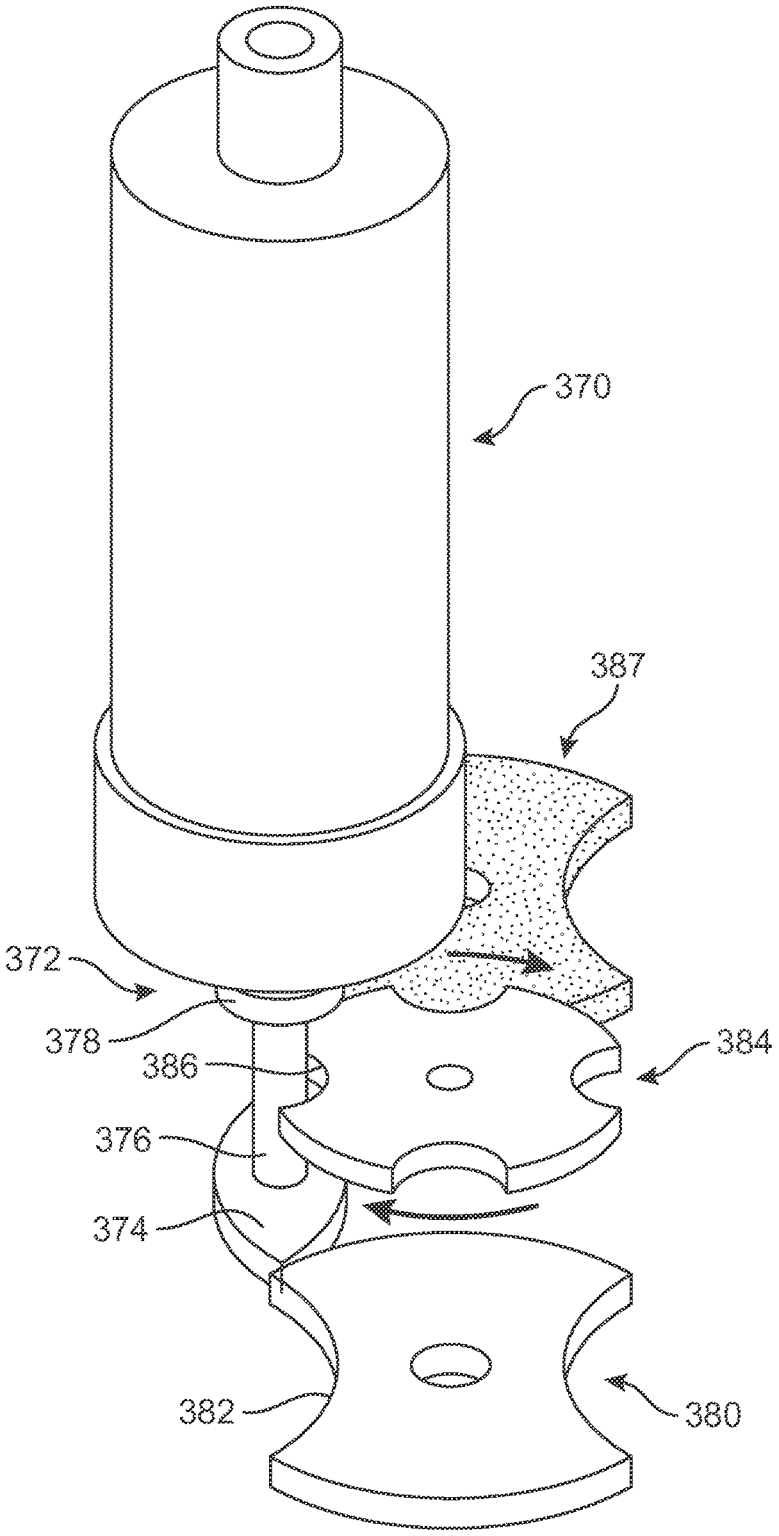
FIG. 7 is a schematic isometric view of several components of a braiding machine.

FIGS. 5-7 illustrate a schematic view of several components of braiding machine 100 shown in isolation for purposes of clarity. Referring first to FIG. 5, carrier element 372 is shown with spool 370 (which may rest on flange portion 378 of carrier element 372). Further, rotor engaging portion 374 is seen to be disposed adjacent concave side 382 of a rotor metal 380. A horn gear 384 is disposed near rotor metal 380 in an adjacent ring. Moreover, horn gear 384 is seen to be between rotor metal 380 of one ring (e.g., an outer ring) and rotor metal 387 of another ring (e.g., an inner ring). For purposes of illustration, other rotor metals, horn gears, spools as well as other parts of braiding machine 100 are not shown in FIGS. 5-7.

In order to ensure that a carrier element and spool can be passed between rotor metals in one ring and horn gears in an adjacent ring, a horn gear may sit at a different axial distance, or height, from a surface of a braiding machine than a rotor metal. That is, the rotor metal and adjacent horn gear may be axially displaced along a central axis of a surface formed by the rings of spools. For example, in FIG. 5, horn gear 384 is indicated as being a height 389 (or axial distance) above rotor metal 380.

Referring now to FIGS. 5-7, carrier element 372 and spool 370 may be passed from a ring with rotor metal 380 (e.g., outer ring 190 shown in FIG. 3) to a different ring with horn gear 384 (e.g., intermediate ring 180 shown in FIG. 3). This may be accomplished by rotating rotor metal 380 until intermediate rod portion 376 of carrier element 372 is engaged by slot 386 of horn gear 384, as seen in FIG. 6. As shown in FIG. 7, horn gear 384 may then be rotated to move carrier element 372 and spool 370 to another adjacent horn gear (not shown). Although this process depicts passing a carrier element and spool from a rotor metal to a horn gear, a similar process may be used to pass a carrier element and spool from a horn gear to a rotor metal. Further, similar processes could be used to pass spools from an outer ring to an intermediate ring, or from an inner ring to an intermediate ring. It may be appreciated that in order for a carrier element to be received into the slot of a horn gear, the horn gear may be rotated simultaneously with the rotor metal that moves the carrier element. This may allow for a smoother passing of the carrier element into the slot of the horn gear since the orientation of the slot can be varied.

With the exemplary arrangement, rotor metal 380 engages with carrier element 372 at rotor engaging portion 374, while horn gear 384 engages with carrier element 372 at intermediate rod portion 376. Since the rotor metal and horn gear engage carrier element 372 at different heights, this configuration reduces any interference that might otherwise occur if a rotor metal and horn gear were placed at a common height (e.g., in a common horizontal plane of a braiding machine). For example, as shown in FIG. 6, this arrangement allows rotor engaging portion 374 to pass below horn gear 384 while intermediate rod portion 376 is engaged with horn gear 384.

Figure 8:
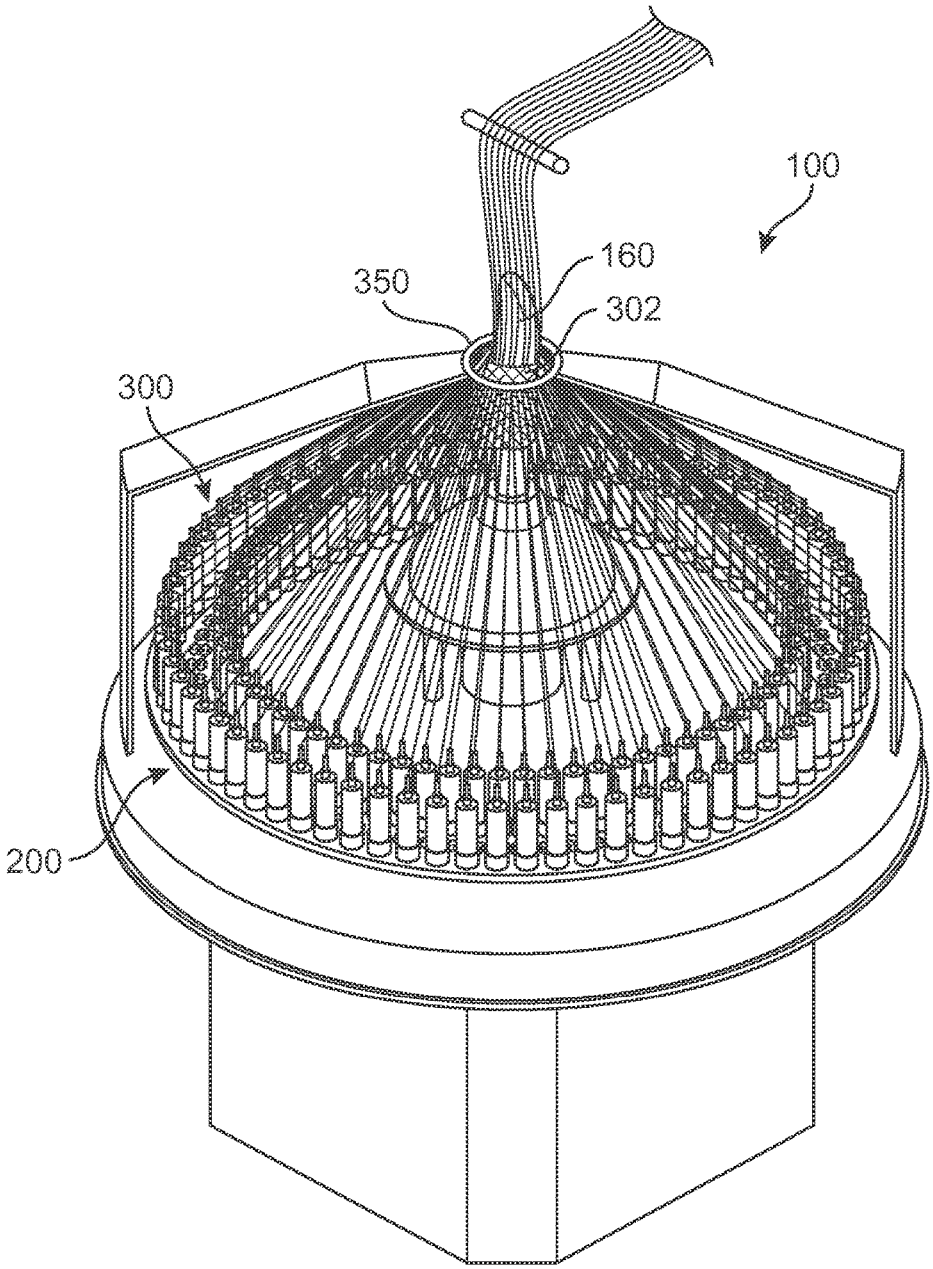
FIG. 8 is a schematic isometric view of a braiding machine including tensile elements.

FIG. 8 illustrates a schematic isometric view of braiding machine 100 in an operational configuration. In particular, a plurality of threads 300 extend from plurality of spools 200 toward last member 160. At last member 160, the plurality of threads 300 are braided into a braided structure 302 on last member 160.

A braiding machine may include provisions to facilitate braiding of threads on a last or other mandrel. Some embodiments may include provisions to hold one or more threads in position proximate a last member or mandrel. In some embodiments, a lace braiding machine may include a thread organization member. The thread organization member may assist in organizing the strands or threads such that entanglement of the strands or threads may be reduced. Additionally, the thread organization member may provide a path or direction through which a braided structure is directed. As depicted in FIG. 8, braiding machine 100 may include a fell or ring 350 to facilitate the organization of a braided structure. The strands or threads of each spool extend toward ring 350 and through ring 350. As plurality of threads 300 extend through ring 350, ring 350 may guide plurality of threads 300 such that threads 300 extend in the same general direction (e.g., radially).

Additionally, in some embodiments, ring 350 may assist in forming the shape of a braided component. In some embodiments, a smaller ring may assist in forming a braided component that encompasses a smaller volume. In other embodiments, a larger ring may be utilized to form a braided component that encompasses a larger volume.

In some embodiments, ring 350 may be located at the braid point. The braid point is defined as the point or area where plurality of threads 300 consolidate to form a braid structure. As plurality of spools 200 pass around braiding machine 100, threads from each spool of plurality of spools 200 may extend toward and through ring 350. Adjacent or near ring 350, the distance between threads from different spools diminishes. As the distance between plurality of threads 300 is reduced, plurality of threads 300 from different spools intermesh or braid with one another in a tighter fashion. The braid point refers to an area where the desired tightness of plurality of threads 300 has been achieved on the braiding machine.

In some embodiments, a tensioner may assist in providing the strands with an appropriate amount of force to form a tightly braided structure. In other embodiments, knives (not shown) may extend from a central fixture or other portion of braiding machine 100. Knives may tighten the strands of the braided structure during braiding. Embodiments may make use of any of the various provisions for controlling the positioning, motion, tension, and or other characteristics of each tensile strand as disclosed in the Fixed Last Braiding application.

As seen in FIG. 8, the exemplary embodiment of braiding machine 100 has an axial configuration. In other words, each spool of plurality of spools 200 is oriented normal to a surface enclosed by ring 350 or the braiding point. Moreover, the alignment of each spool in the various rings of spool system 104 are seen to be identical, with each ring having an axial configuration.

In some embodiments, the movement of plurality of spools 200 may be programmable. In some embodiments, the movement of plurality of spools 200 may be programmed into a computer system. In other embodiments, the movement of plurality of spools 200 may be programmed using a punch card or other device. The movement of plurality of spools 200 may be pre-programmed to form particular shapes, designs, and thread density of a braided component.

In some embodiments, each spool of plurality of spools 200 may not occupy each of the gaps between adjacent rotor metals (e.g., gap 226 (see FIG. 4)). In some embodiments, every other gap may include a spool. In other embodiments, a different configuration of spools may be placed within each of the gaps. As first set of rotor metals 270, set of horn gears 280, and second set of rotor metals 290 rotate (see FIG. 4), the location of each of the plurality of spools 200 may change. In this manner the configuration of the spools and the location of the spools in the various gaps may vary throughout the braiding process.

Figure 23:
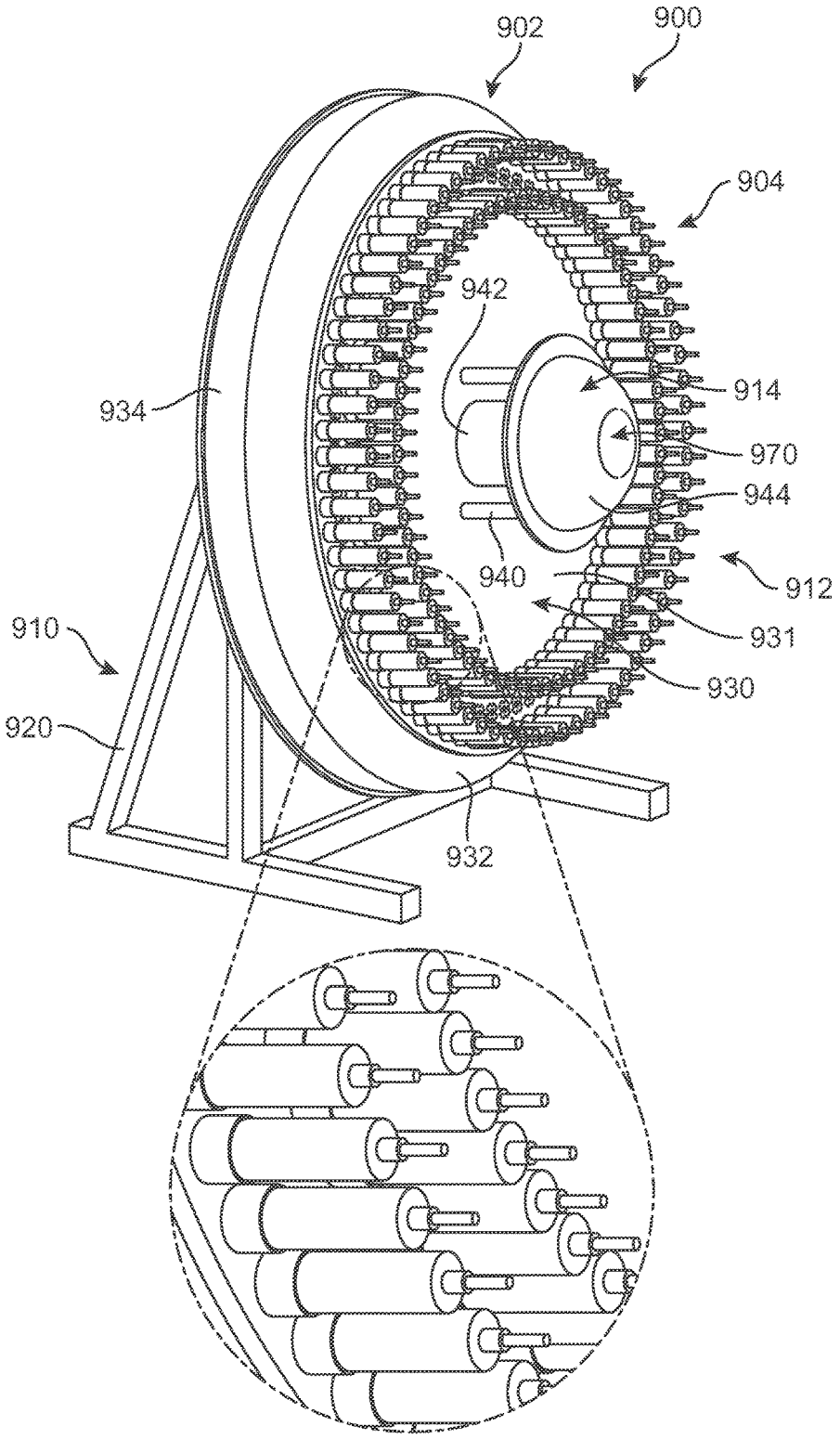
FIG. 23 is a schematic isometric view of another embodiment of a braiding machine.
Figure 24:
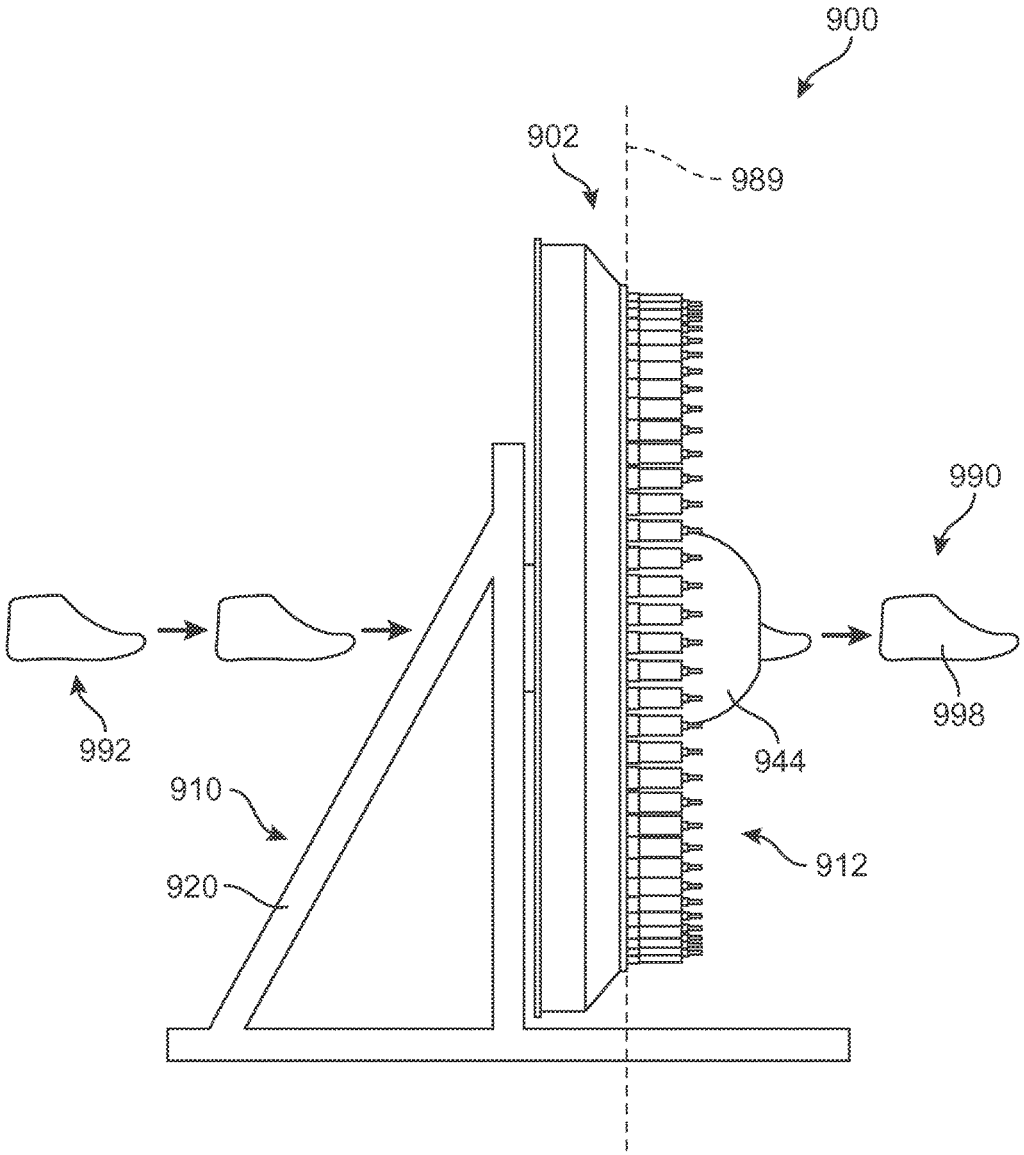
FIG. 24 is a schematic side view of the braiding machine of FIG. 23.
Figure 25:
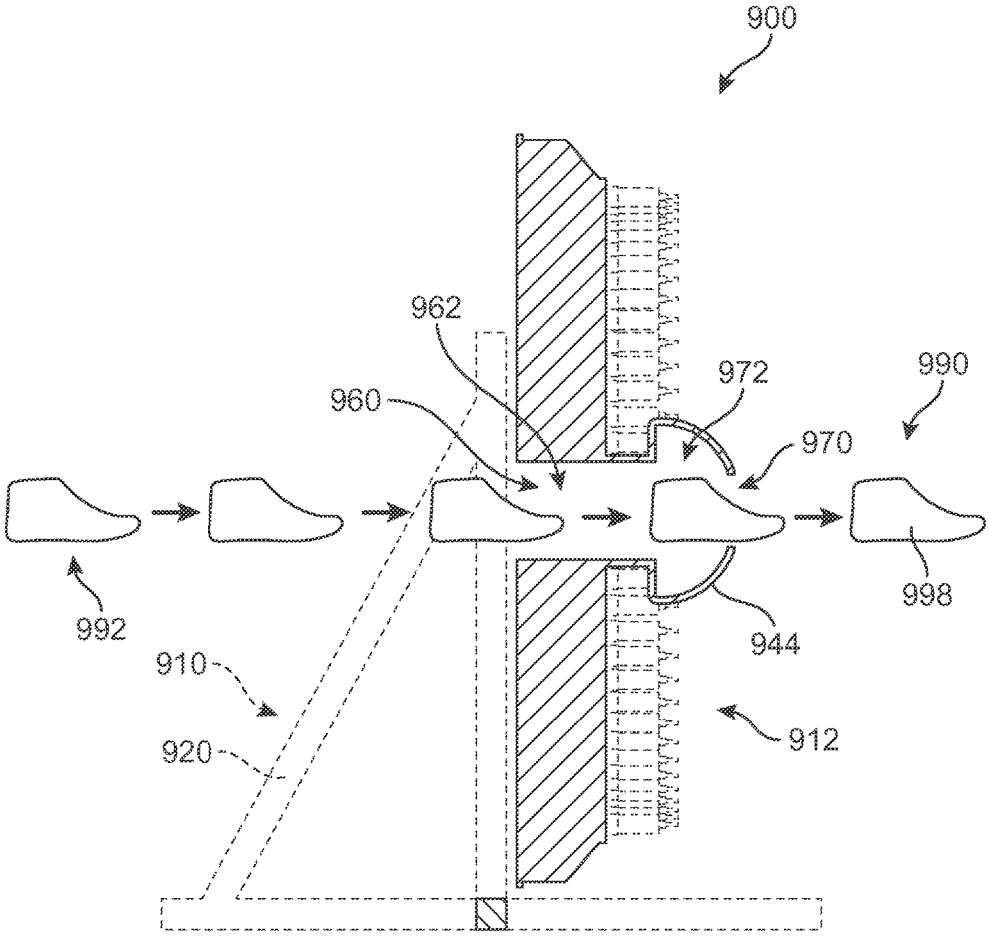
FIG. 25 is a schematic side cross-sectional view of the braiding machine of FIG. 23.

In at least some embodiments, it is contemplated that individual spools or bobbins may utilize automatic tensioning provisions. For example, any systems or devices known in the art for automatically tensioning the threads of spools or bobbins may be used to ensure each thread has a predetermined degree of tension during operation. Such automatic tensioning provisions may be utilized both in machines of horizontal configuration (FIGS. 1-22) and in machines of vertical configuration (FIGS. 23-25).

FIGS. 9-19 illustrate schematic views of a process in which a spool is passed between different rings of spool system 100. For purposes of clarity, the embodiment of FIGS. 9-19 depict components schematically, and do not include all the components of spool system 104. For example, rotor metals of the inner and outer rings, horn gears, and two spools are depicted, but carrier elements, gears, and other components required for the operation of spool system 104 are not shown. Moreover, it may be appreciated that only a small section of inner ring 170, intermediate ring 180 and outer ring 190 are shown in FIGS. 9-19 and that other sections of each ring may operate in a substantially similar manner.

Figure 9:
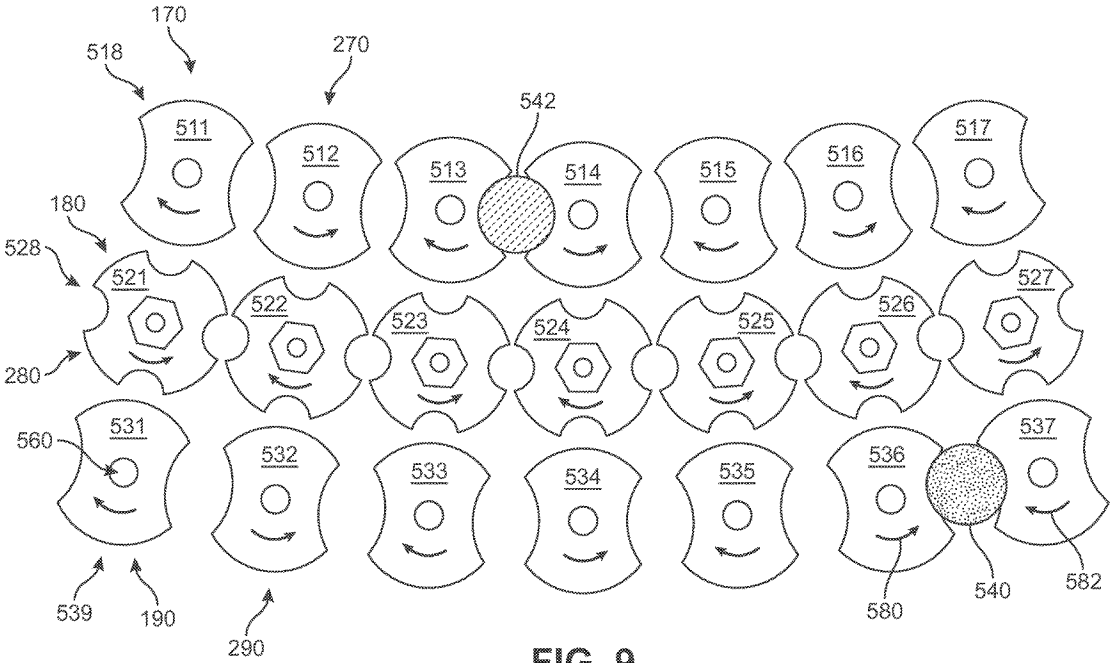
FIG. 9 is a schematic view of a step in an exemplary hand-off sequence passing a spool between outer and inner rings of a braiding machine.

Referring first to FIG. 9, small sections of inner ring 170, intermediate ring 180 and outer ring 190 are shown. Specifically, seven rotor metals of first set of rotor metals 270 along inner ring 170 are shown. These include first rotor metal 511, second rotor metal 512, third rotor metal 513, fourth rotor metal 514, fifth rotor metal 515, sixth rotor metal 516 and seventh rotor metal 517, hereby referred to collectively as rotor metal group 518. In addition, seven horn gears of set of horn gears 280 along intermediate ring 180 are shown. These include first horn gear 521, second horn gear 522, third horn gear 523, fourth horn gear 524, fifth horn gear 525, sixth horn gear 526 and seventh horn gear 527, hereby referred to collectively as horn gear group 528. In addition, seven rotor metals of second set of rotor metals 290 along outer ring 190 are shown. These include first rotor metal 531, second rotor metal 532, third rotor metal 533, fourth rotor metal 534, fifth rotor metal 535, sixth rotor metal 536 and seventh rotor metal 537, hereby referred to collectively as second set of rotor metals 539.

FIGS. 9-19 also illustrate two spools: first spool 540, also referred to simply as spool 540, and second spool 542. In FIG. 9, first spool 540 is shown to be initially located in outer ring 190 between sixth rotor metal 536 and seventh rotor metal 537. Second spool 542 is shown to be initially located in inner ring 170 between third rotor metal 513 and fourth rotor metal 514. Of course, it may be appreciated that these spools may be passed around on carrier elements, which are not shown for purposes of clarity.

Each rotor metal and horn gear is capable of rotating about a central position or axis. For example, first rotor metal 531 in outer ring 190 can rotate about central axis 560. Similarly, each of the remaining rotor metals in spool system 104 can rotate about a corresponding central axis. Rotor metals may be configured to rotate in a clockwise or counterclockwise direction. As used herein, clockwise and counterclockwise correspond to a rotational direction as viewed along a rotational axis of the part (e.g., rotor metal or horn gear) and in a direction looking down on braiding machine 100 (i.e., as viewed in FIG. 3). In some embodiments, adjacent rotor metals may rotate in opposite directions. For example, sixth rotor metal 536 in outer ring 190 may be configured to rotate in a counterclockwise direction 580. In contrast, seventh rotor metal 537 in outer ring 190 may be configured to rotate in a clockwise direction 582. Similarly, adjacent rotor metals in inner ring 170 and adjacent horn gears in intermediate ring 180 may likewise rotate in opposing directions. Although the exemplary embodiments depict a configuration where adjacent rotor metals rotate in opposing directions, some other embodiments could have configurations where each rotor metal may turn clockwise at some times and counterclockwise at other times. Such a configuration is known to be used on F-Torchon type braiding machines.

Horn gears of spool system 104 may also be configured to rotate in a clockwise or counterclockwise direction. As with the rotor metals, in some embodiments, adjacent horn gears may be configured to rotate in opposing directions. For example, sixth horn gear 526 may rotate in a clockwise direction while seventh horn gear 527 may rotate in a counterclockwise direction. For purposes of clarity, the exemplary rotational directions of each rotor metal and horn gear shown in FIG. 9 has been indicated schematically with a clockwise or counterclockwise directional arrow.

In some embodiments, spools may be passed along inner ring 170 and/or along outer ring 190. Specifically, one or more spools may be passed between adjacent rotor metals such that the spools remain on inner ring 170 or outer ring 190 without being transferred to the horn gears in intermediate ring 180. Alternatively, the embodiments provide a mechanism for passing spools from outer ring 190 to inner ring 170 as well as for passing spools from inner ring 170 to outer ring 190. In at least some embodiments, the horn gears of intermediate ring 180 may act to pass spools directly between inner ring 170 and outer ring 190, without transferring the spools between adjacent horn gears. In other words, in some embodiments, spools may never be passed directly between adjacent horn gears (e.g., from one horn gear to another), and intermediate ring 180 may function as a transfer, or hand-off, ring. This may be in contrast to embodiments where a single ring of horn gears facilitates the formation of a radial braid by passing spools between adjacent horn gears.

An exemplary spool "hand-off" sequence is depicted schematically in FIGS. 9-19. For purposes of clarity, only two spools are depicted in this sequence. However, it may be appreciated that any spool paths that are consistent with the exemplary sequence may be utilized in forming various kinds of braiding structures with braiding machine 100.

In FIG. 9, a first spool 590 is seen to be positioned between sixth rotor metal 536 and seventh rotor metal 537 in outer ring 190. In addition, a second spool 592 is seen to be positioned between third rotor metal 513 and fourth rotor metal 514 on inner ring 170. It may be understood that first spool 590 and second spool 592 may be positioned on carrier elements of some kind, which are not shown for purposes of clarity. Moreover, the relative sizes of first spool 590 and second spool 592, relative to the rotor metals and horn gears, may vary from one embodiment to another.

Figure 10:
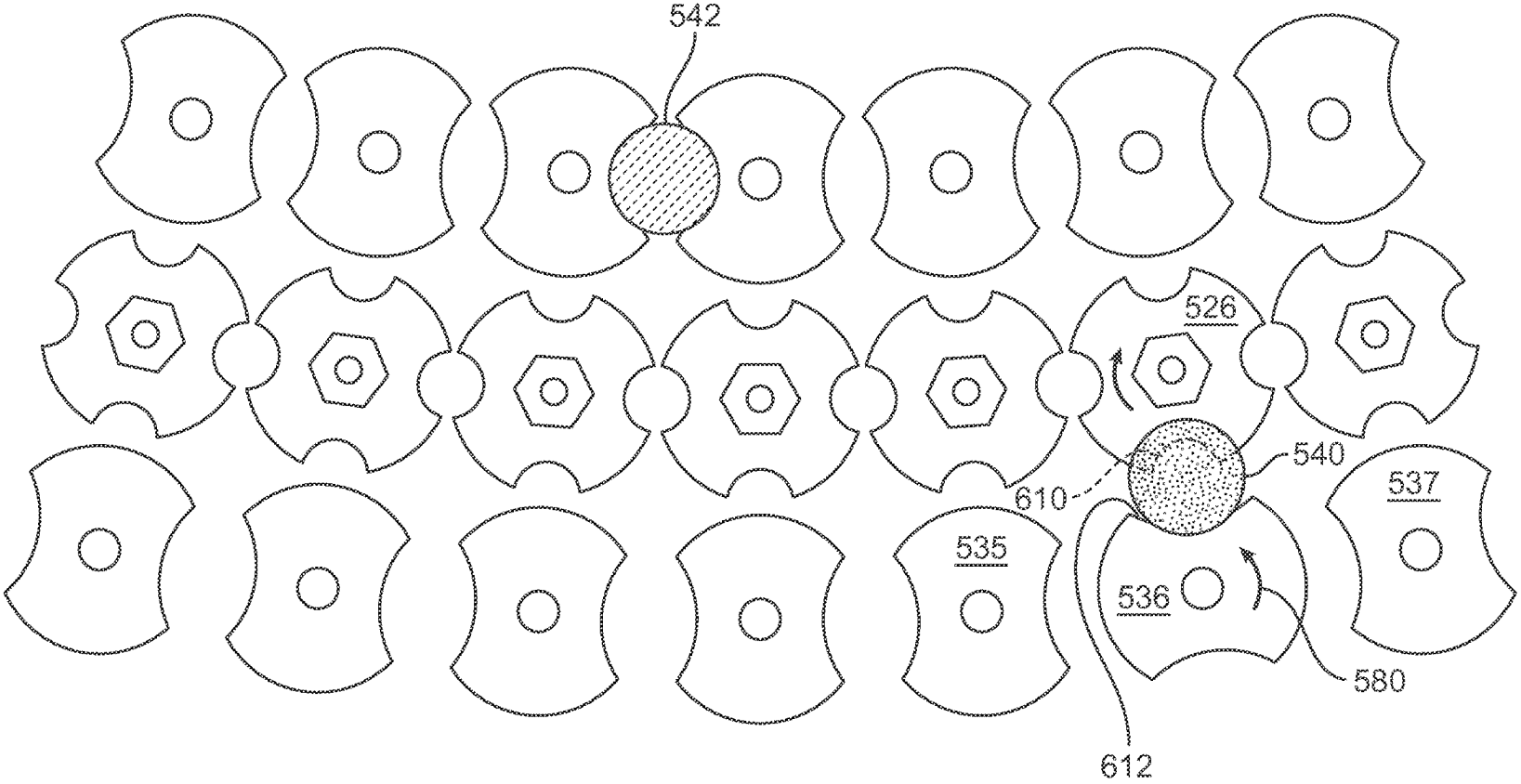
FIG. 10 is a schematic view of a step in an exemplary hand-off sequence passing a spool between outer and inner rings of a braiding machine.
Figure 11:
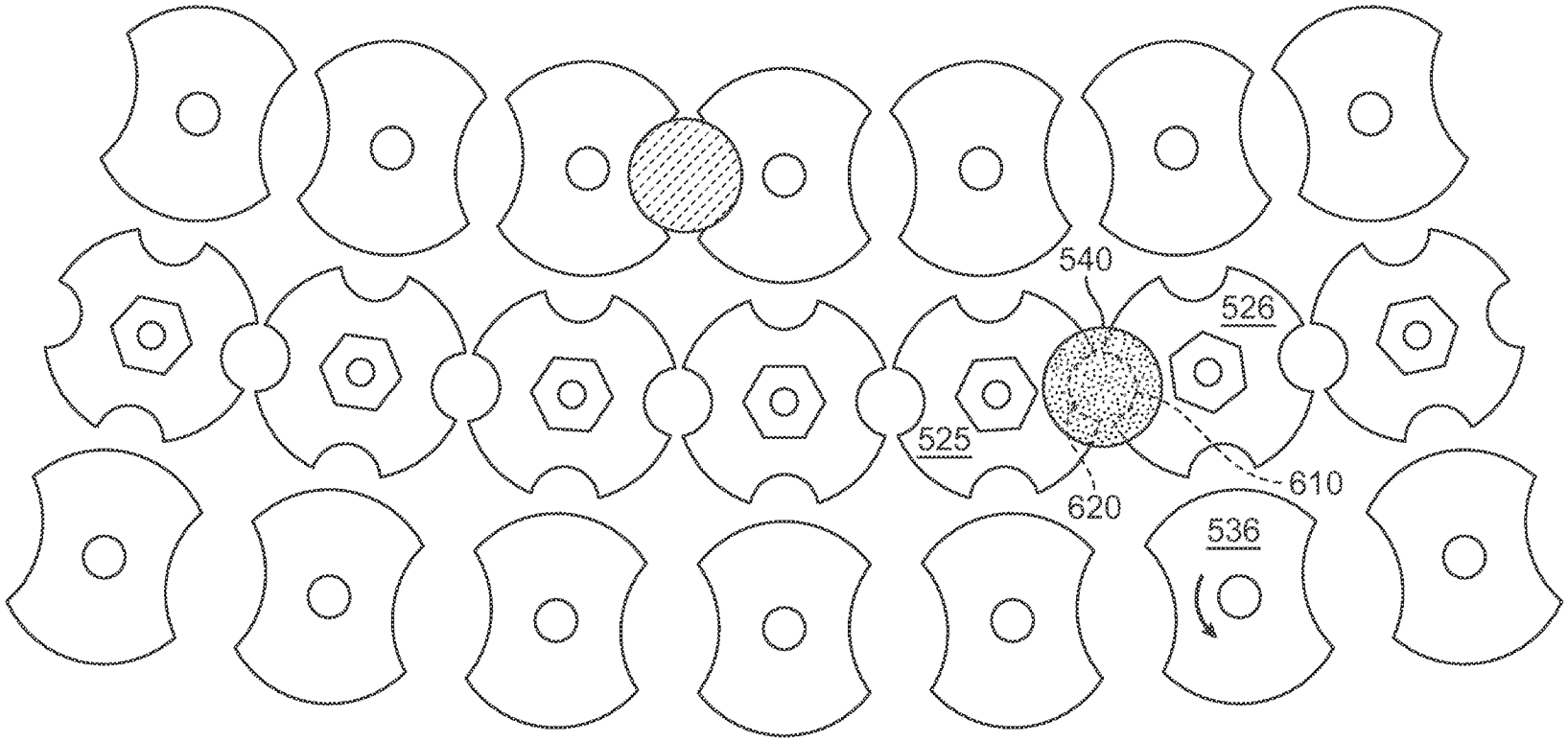
FIG. 11 is a schematic view of a step in an exemplary hand-off sequence passing a spool between outer and inner rings of a braiding machine.

In FIG. 10, sixth rotor metal 536 rotates in a counter-clockwise direction 580 by approximately 90 degrees. As sixth rotor metal 536 rotates, first spool 590 is carried, or moved, by sixth rotor metal 536 and positioned proximate a slot 610 of sixth horn gear 526. At this point, the carrier element (not shown) holding first spool 590 may be transferred from the concave side 612 of sixth rotor metal 536 to slot 610 of sixth horn gear 526. Once first spool 590 has been transferred to sixth horn gear 526, first spool 590 may be seen to continue rotating with sixth horn gear 526 until first spool 590 is positioned proximate a slot 620 of fifth horn gear 525, as seen in FIG. 11. First spool 590 may then be transferred from slot 610 of sixth horn gear 526 to slot 620 of fifth horn gear 525.

Figure 12:
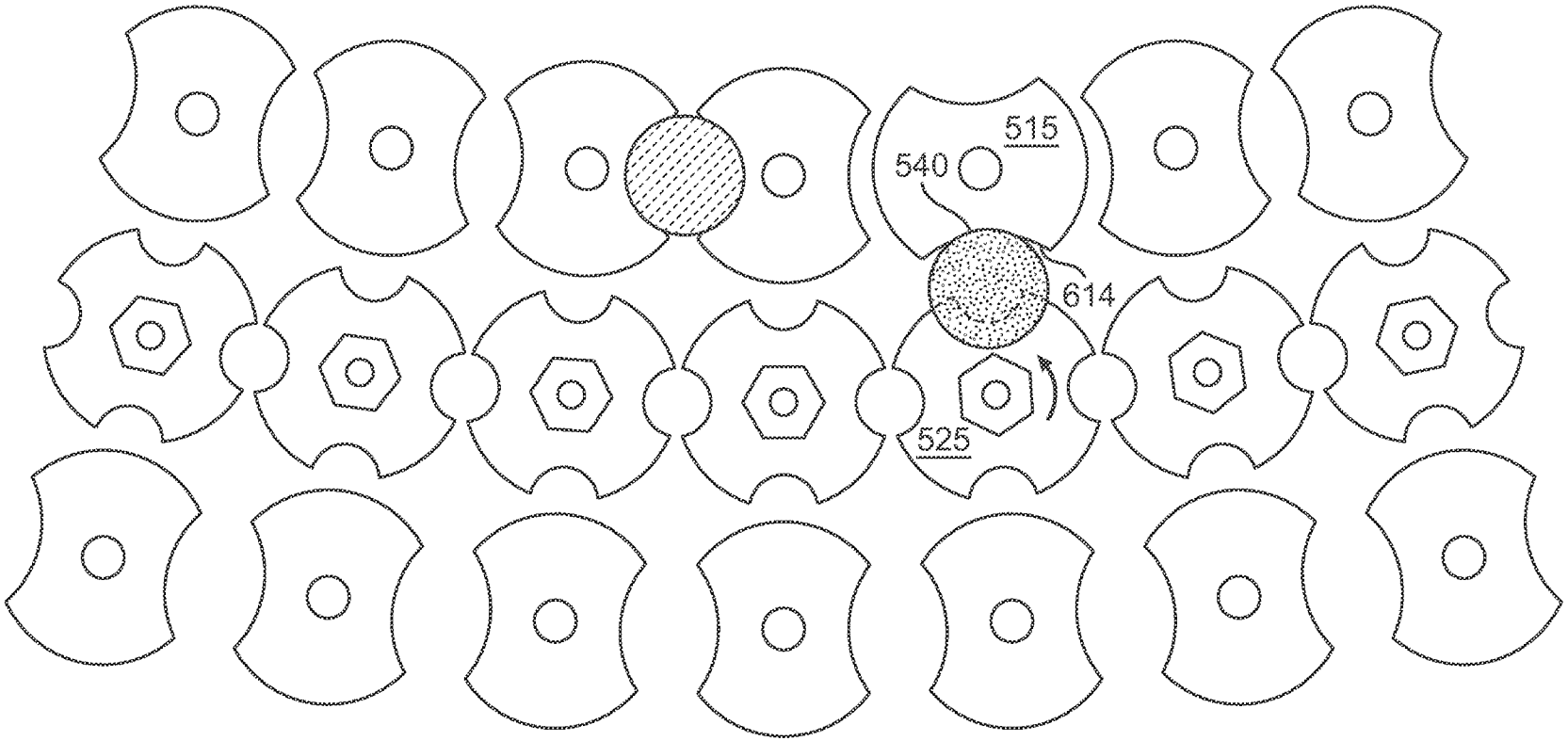
FIG. 12 is a schematic view of a step in an exemplary hand-off sequence passing a spool between outer and inner rings of a braiding machine.
Figure 13:
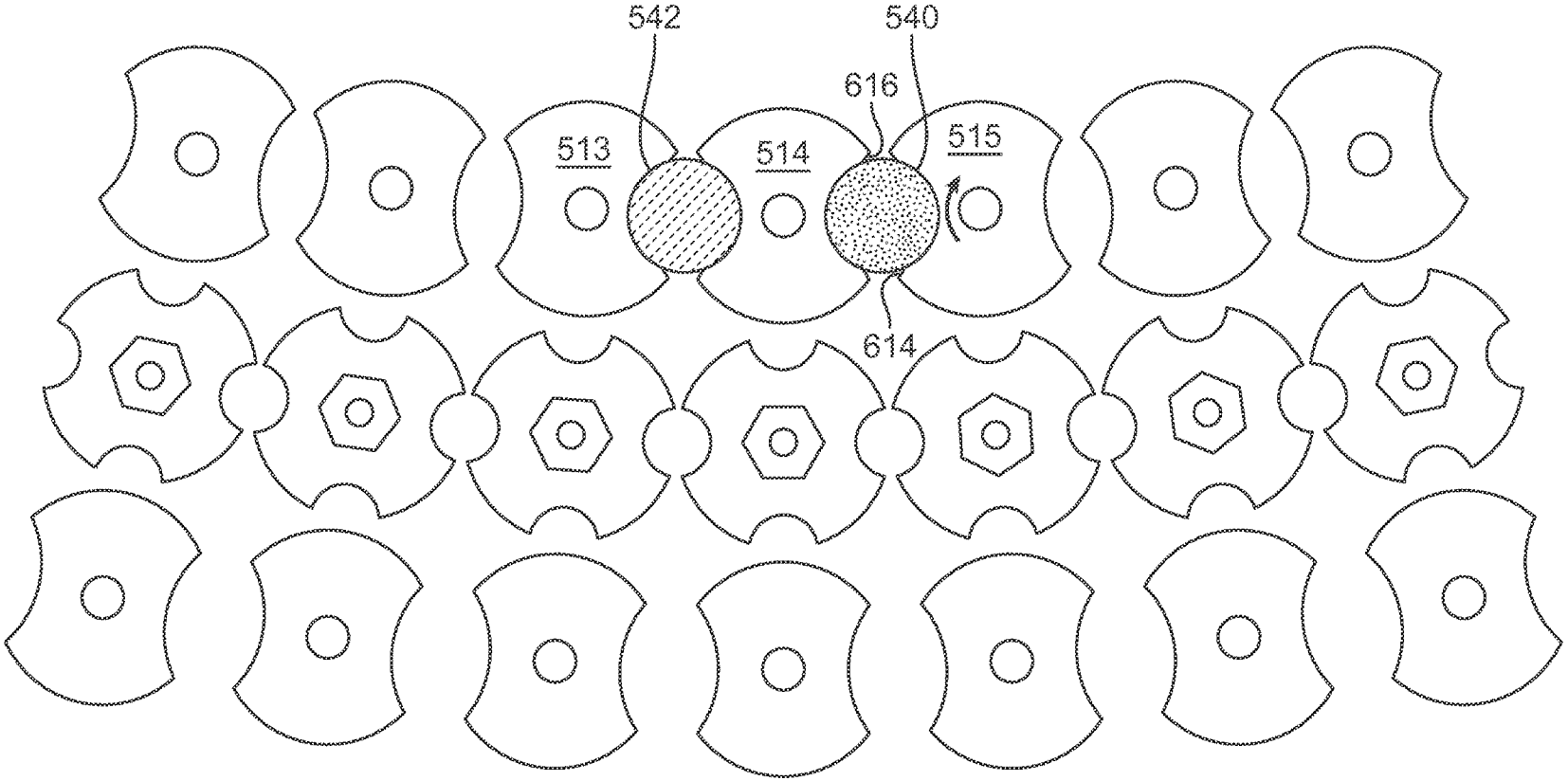
FIG. 13 is a schematic view of a step in an exemplary hand-off sequence passing a spool between outer and inner rings of a braiding machine.

In FIG. 12, it may be seen that first spool 590 is rotated along with fifth horn gear 525 to a position proximate fifth rotor metal 515 along inner ring 170. It can also be seen in FIG. 12 that fifth rotor metal 515 has been rotated by approximately 90 degrees from the previous configuration shown in FIG. 11, so that fifth rotor metal 515 is positioned to receive first spool 590 at concave side 614 of fifth rotor metal 515. From this position, first spool 590 is further rotated to be disposed between fifth rotor metal 515 and fourth rotor metal 514, as seen in FIG. 13. Specifically, first spool 590 (and its associated carrier element) may be positioned between concave side 614 of fifth rotor metal 515 and concave side 616 (see FIGS. 13-15) of fourth rotor metal 514.

Figure 14:
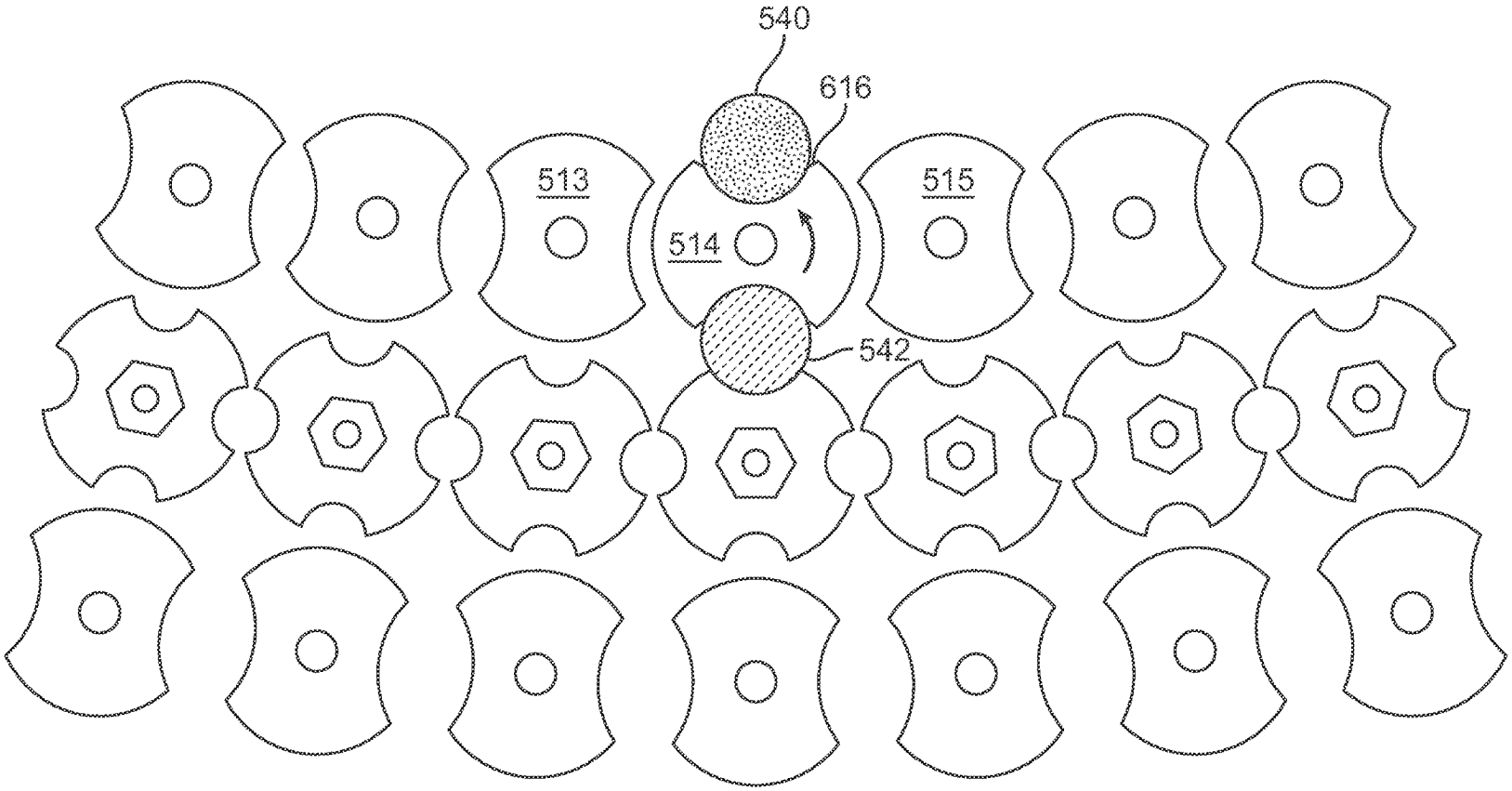
FIG. 14 is a schematic view of a step in an exemplary hand-off sequence passing a spool between outer and inner rings of a braiding machine.
Figure 15:
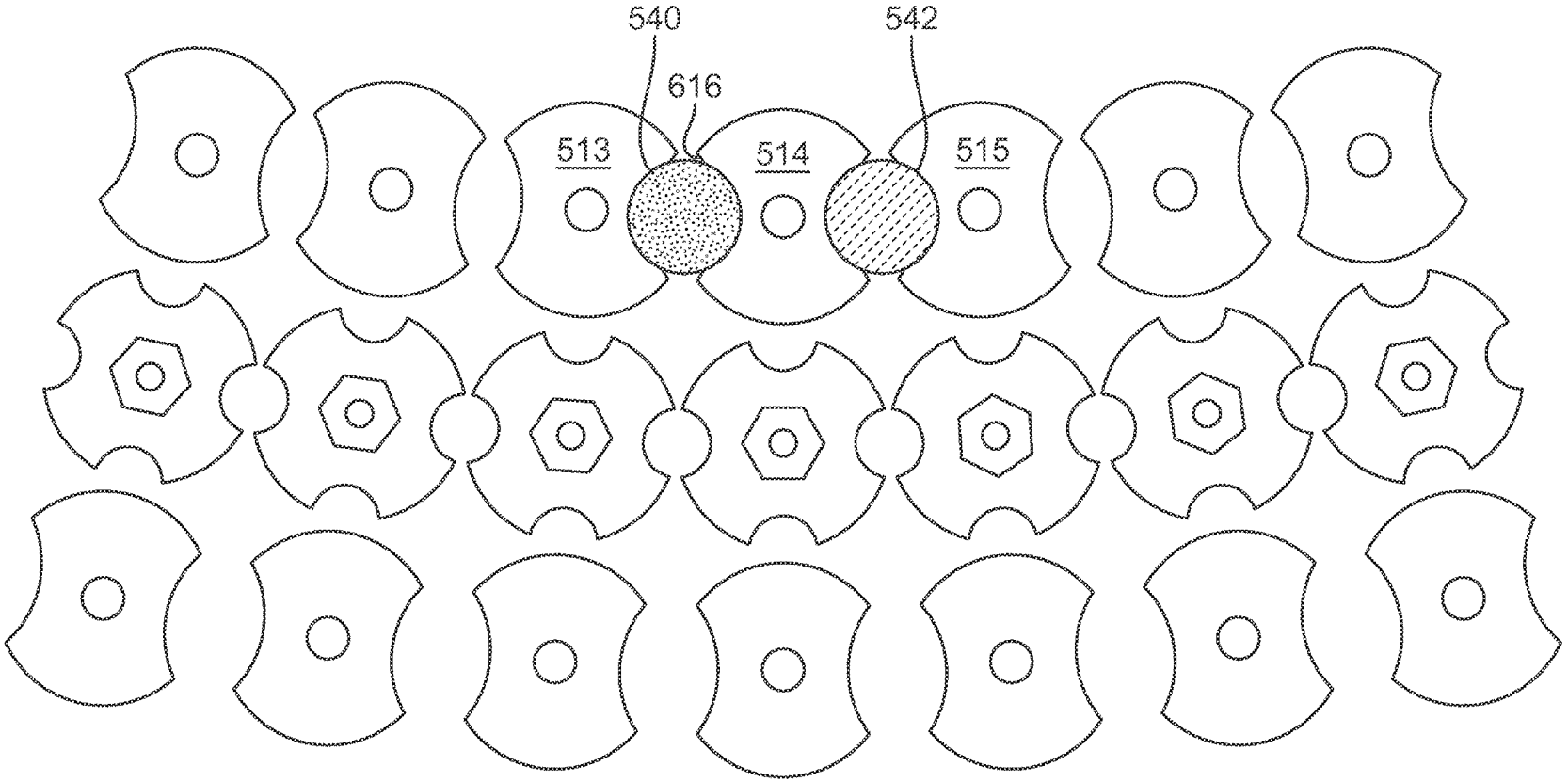
FIG. 15 is a schematic view of a step in an exemplary hand-off sequence passing a spool between outer and inner rings of a braiding machine.
Figure 16:
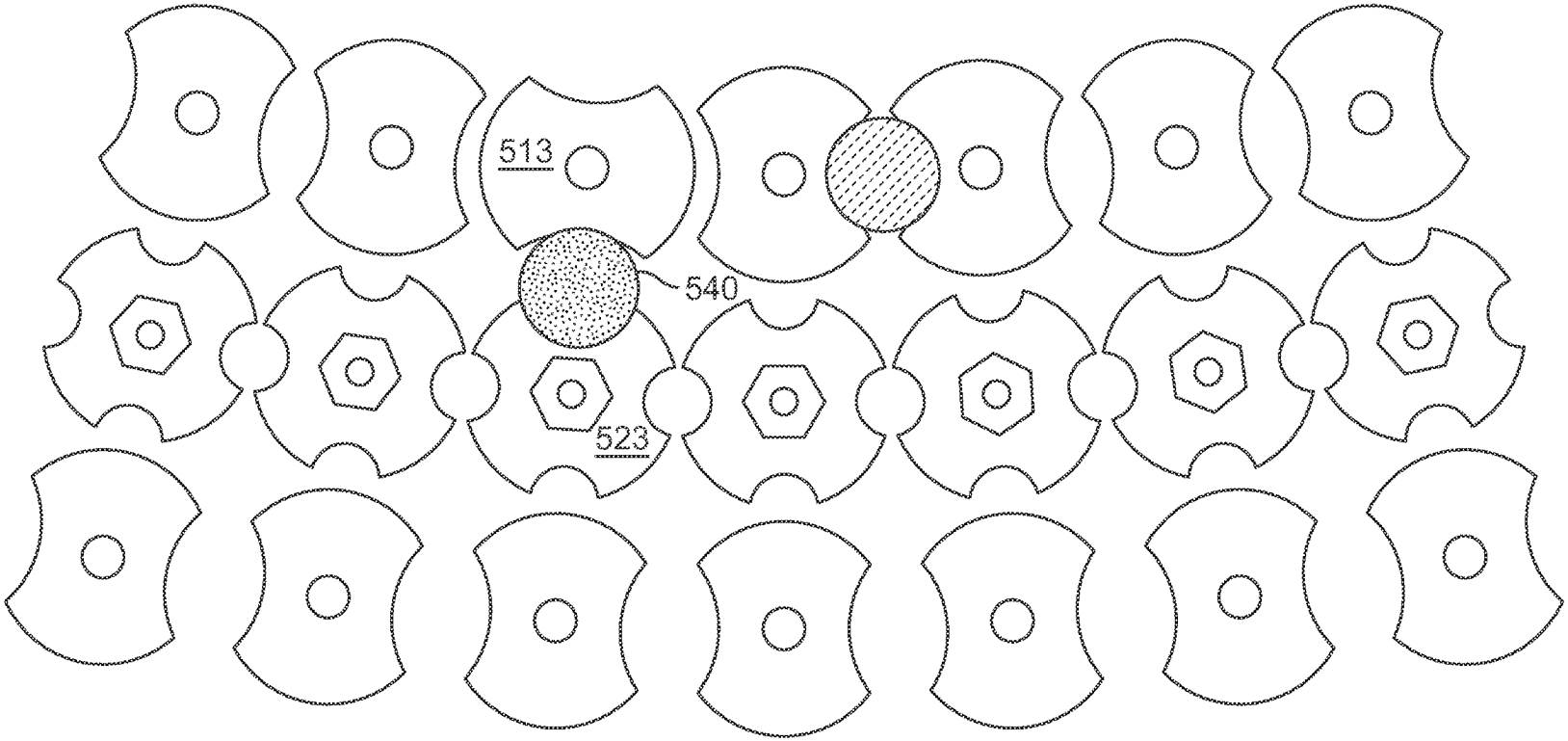
FIG. 16 is a schematic view of a step in an exemplary hand-off sequence passing a spool between outer and inner rings of a braiding machine.

FIGS. 13-15 illustrate a sub-sequence of the process of FIGS. 9-19, in which first spool 590 and second spool 592 are interchanged, which thereby may result in intertwined strands (not shown) for braiding at the center of braiding machine 100. As seen in FIGS. 13-15, fourth rotor metal 514 rotates by approximately 180 degrees thereby interchanging the positions of first spool 590 and second spool 592.

Figure 17:
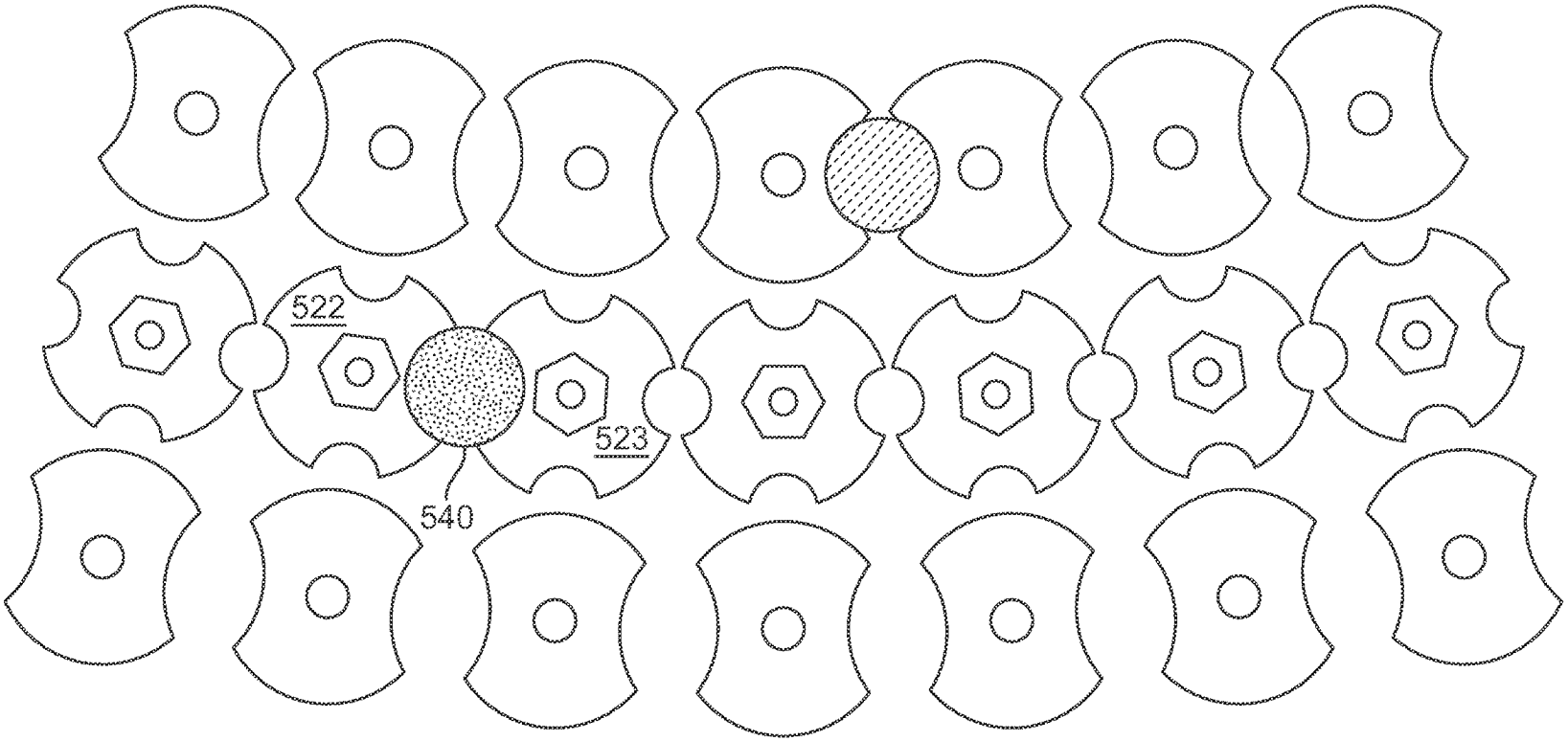
FIG. 17 is a schematic view of a step in an exemplary hand-off sequence passing a spool between outer and inner rings of a braiding machine.
Figure 18:
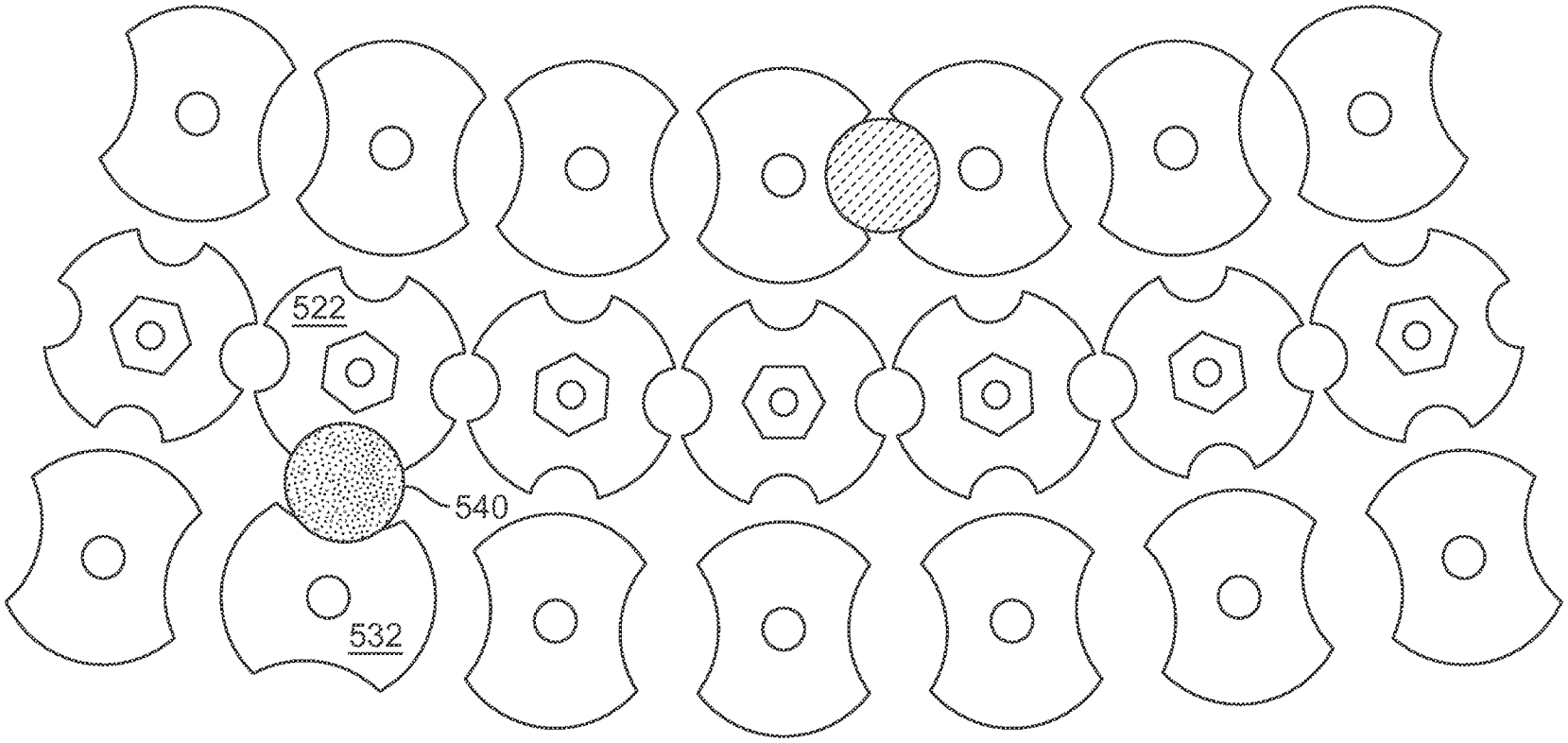
FIG. 18 is a schematic view of a step in an exemplary hand-off sequence passing a spool between outer and inner rings of a braiding machine.
Figure 19:
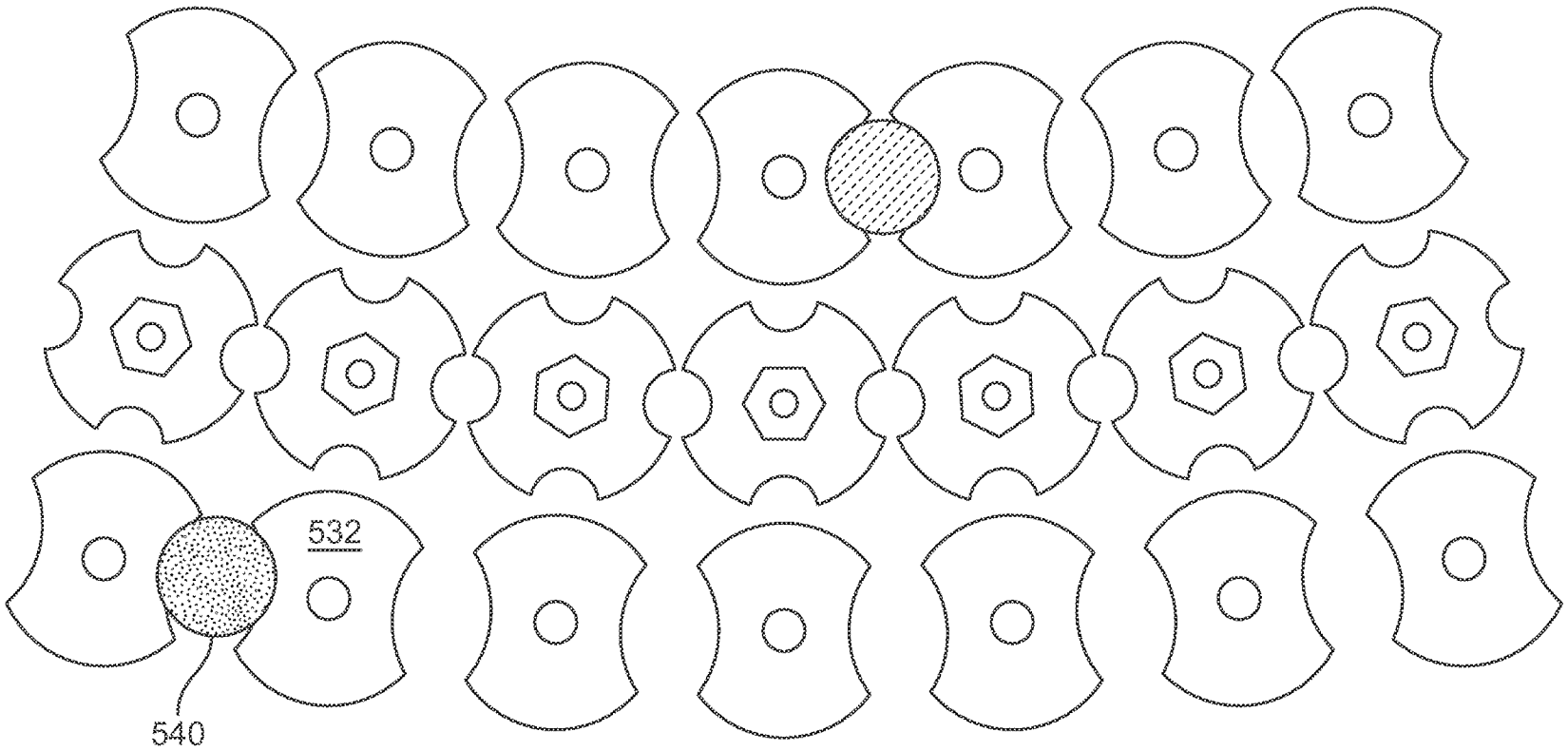
FIG. 19 is a schematic view of a step in an exemplary hand-off sequence passing a spool between outer and inner rings of a braiding machine.

From the spool positions shown in FIG. 15, first spool 590 may proceed to pass back from inner ring 170, across intermediate ring 180 and to outer ring 190, while second spool 592 may maintain a fixed position. Specifically, first spool 590 is passed from third rotor metal 513 (see FIGS. 13-15) to third horn gear 523, as in FIG. 16. From third horn gear 523, first spool 590 is rotated proximate to, and transferred to, second horn gear 522, as seen in FIG. 17. Finally, first spool 590 is passed from second horn gear 522 to second rotor metal 532 as seen in FIGS. 18-19.

The system shown in FIGS. 1-19 may allow for the passing of spools between inner ring 170 and outer ring 190, or vice versa. Moreover, the exemplary system allows for a subset of spools to run only on inner ring 170 and/or only on outer ring 190. Thus the three ring configuration may allow for many possible spool paths running along inner ring 170, across intermediate ring 180 and/or running along outer ring 190, which may facilitate the making of various kinds of braided articles having various different layers and/or braided patterns.

It is contemplated that in some embodiments spools could be controlled in a manner to avoid collisions along any of the rings as spools are passed between rings. For example, in operating configurations where there are no open gaps or spaces between rotor metals on either the inner or outer ring, spool movement between rings may be coordinated to ensure that spools don't collide when arriving at the inner or outer ring. In some embodiments, for example, the motions of spools may be coordinated so that as a spool leaves the outer ring to transition to the inner ring, another spool in the inner ring transitions out of the inner ring to the intermediate ring, thereby opening a space for the spool transitioning from the outer ring to the inner ring. Thus, it may be appreciated that the spool motions between rings may be coordinated to ensure no collisions between spools occur at the outer ring, at the intermediate ring or at the inner ring.

It is also contemplated that in at least some embodiments, the horn gears disposed in the intermediate ring (e.g., intermediate ring 180) may be capable of independent rotational motion, rather than being controlled such that each gear has a constant direction and rate of rotation. In other words, in some other embodiments, horn gears could be controlled in jacquard motions, rather than only non-jacquard motions. This independent control for each horn gear might allow for more refined control over the movement of spools passing between rings, and in some cases may allow spools to pass along the intermediate ring in a holding pattern until spaces are opened in either the inner or outer ring.

Figure 20:
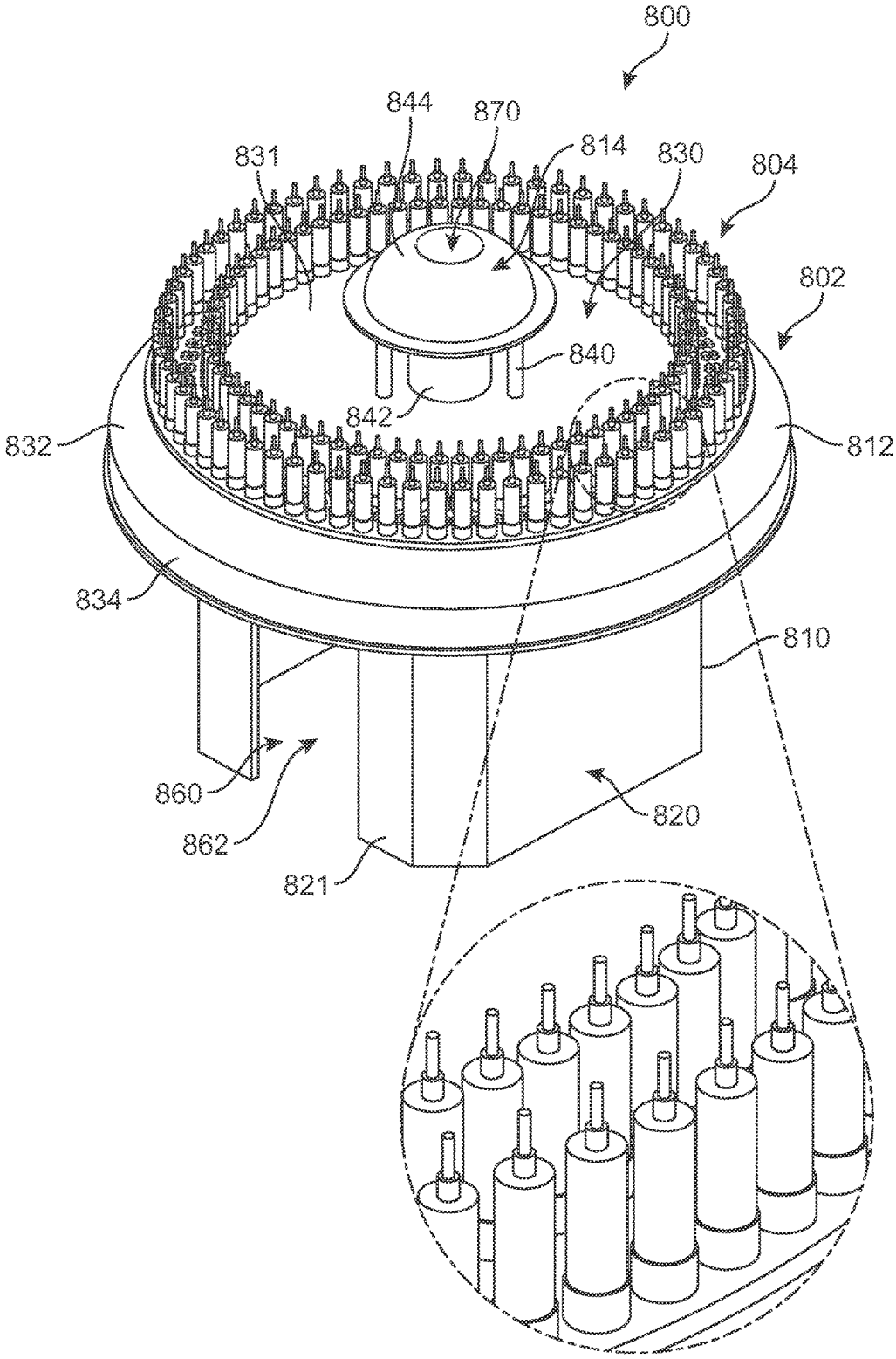
FIG. 20 is a schematic isometric view of another embodiment of a braiding machine.
Figure 21:
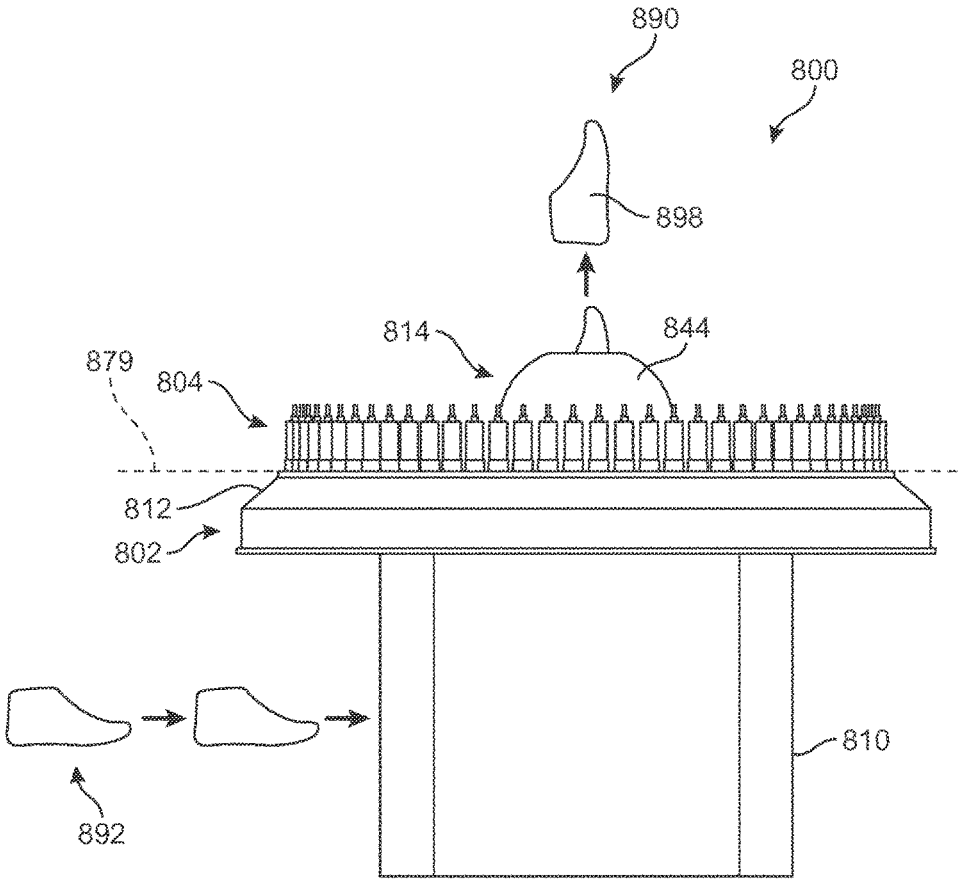
FIG. 21 is a schematic side view of the braiding machine of FIG. 20.
Figure 22:
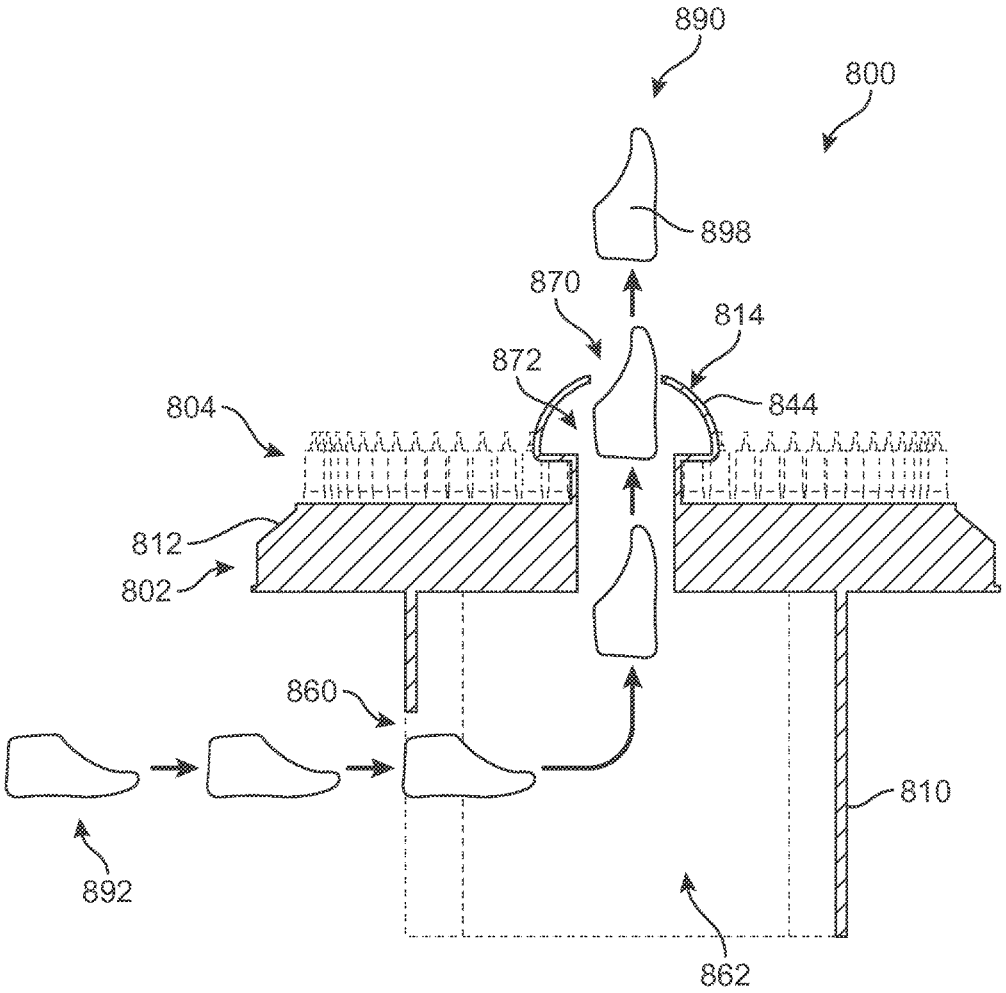
FIG. 22 is a schematic side cross-sectional view of the braiding machine of FIG. 20.

FIGS. 20 through 22 illustrate another embodiment of a braiding machine. Specifically, FIG. 20 illustrates an isometric view of an embodiment of a braiding machine 800. FIG. 21 illustrates a side view of an embodiment of braiding machine 800, while FIG. 22 illustrates a cross-sectional side view of an embodiment of braiding machine 800.

Braiding machine 800 may share some features of braiding machine 100, which has been disclosed above and shown in FIGS. 1-19. Braiding machine 800 may include a support structure 802 and a spool system 804. In some embodiments, spool system 804 may have a similar or even identical configuration to spool system 104, including any of the various variations described above for spool system 104. In an exemplary embodiment, for example, spool system 804 may be configured as a three-ring system, including an outer ring of rotor metals, an inner ring of rotor metals, and an intermediate ring of horn gears that act to pass spools around the surface of braiding machine 800. Thus, it may be appreciated that spool system 804 may be configured with any of the parts and features discussed above for spool system 104.

Support structure 802 may share some similar features with support structure 102. For example, support structure 802 may be comprised of a base portion 810, a top portion 812 and a central fixture 814. However, in contrast to support structure 102, which is configured for a fixed last or mandrel, the embodiment shown in FIGS. 20-22 includes additional features that may facilitate the use of a moveable last or mandrel.

Referring to FIG. 20, in some embodiments, top portion 812 may comprise a top surface 830, which may further include a central surface portion 831 and a peripheral surface portion 832. Top portion 812 may also include a sidewall surface 834 that is proximate peripheral surface portion 832. In the exemplary embodiment, top portion 812 has an approximately circular geometry, though in other embodiments, top portion 812 could have any other shape. Moreover, in the exemplary embodiment, top portion 812 is seen to have an approximate diameter that is larger than a width of base portion 810, so that top portion 812 extends beyond base portion 810 in one or more horizontal directions.

Base portion 810 may comprise one or more walls 820 of material. In the exemplary embodiment, base portion 810 is comprised of four walls 820 that form an approximately rectangular base for braiding machine 800. However, in other embodiments, base portion 810 could comprise any other number of walls arranged in any other geometry. In this embodiment, base portion 810 acts to support top portion 812 and may therefore be formed in a manner so as to support the weight of top portion 812, as well as central fixture 814 and spool system 804, which are attached to top portion 812.

In order to provide means for passing lasts, mandrels, or similar provisions through braiding machine 800, the embodiment includes at least one sidewall opening 860 in base portion 810. In the exemplary embodiment, sidewall opening 860 may be disposed on wall 821 of walls 820. Sidewall opening 860 may further provide access to a central cavity 862 within base portion 810.

Braiding machine 800 may include central fixture 814. In the exemplary embodiment, central fixture 814 includes one or more legs 840 and a central base 842. Central fixture 814 also includes a dome portion 844. In other embodiments, however, central fixture 814 could have any other geometry. As seen in FIG. 20, dome portion 844 includes an opening 870. Opening 870 is further connected to a central fixture cavity 872, which is best seen in FIG. 22.

Components of support structure could be comprised of any materials. Exemplary materials that could be used include any materials with metals or metal alloys including, but not limited to, steel, iron, steel alloys, and/or iron alloys.

The embodiment of FIGS. 20-22 includes a moveable last system 890, which is depicted schematically in FIGS. 21 and 22. Moveable last system 890 further includes a plurality of lasts 892. Plurality of lasts 892 may be configured to enter braiding machine 800 through sidewall opening 860, pass through central cavity 862 and central fixture cavity 872, before finally passing out of opening 870 in dome portion 844. As each last emerges from opening 870, the last may pass through a braiding point of braiding machine 800 such that threads may be braided onto the surface of the last (not shown).

The lasts of plurality of lasts 892 may have any size, geometry, and/or orientation. In the exemplary embodiment, each last of plurality of lasts 892 comprises a three-dimensional contoured last in the shape of a foot (i.e., last member 898 is a footwear last). However, other embodiments could utilize lasts having any other geometry that are configured for forming braided articles with a preconfigured shape.

Upon entering braiding machine 800, each last may move in an approximately horizontal direction, which is any direction approximately parallel with top surface 830. After passing through sidewall opening 860 and into cavity 862, each last may then be rotated by approximately 90 degrees so that the last begins moving in an approximately vertical direction. The vertical direction may be a direction that is normal or perpendicular to top surface 830 of braiding machine 800. It may be appreciated that in some embodiments each last may be quickly rotated through 90 degrees to change the direction of its path. In other embodiments, each last may be turned along a curve such that the last is slowly rotated through approximately 90 degrees.

A moveable last system may include provisions for moving lasts through a braiding machine, including provisions for changing the direction in which the lasts move. These provisions could include various tracks, rollers, cables or other provisions for supporting lasts along a predetermined path.

The embodiments of FIGS. 1-22 depict braiding machines that have a horizontal configuration. Specifically, the plane associated with the spool systems of each embodiment is a horizontal plane. As used here, a horizontal plane is a plane that is approximately parallel with a ground surface that supports a braiding machine. In addition, a vertical plane is a plane that is approximately perpendicular with a ground surface that supports a braiding machine.

As seen in FIG. 2, spool system 104 may be associated with a horizontal plane 189 that intersects each spool in spool system 104. Alternatively, the horizontal configuration of braiding machine 100 can be characterized by the configuration of rotor metals and horn gears on top surface 130. Specifically, the rotor metals (e.g., first set of rotor metals 270 of FIG. 4) and horn gears (e.g., set of horn gears 280 of FIG. 4) of braiding machine 100 may also coincide with, or be parallel with, horizontal plane 189.

As seen in FIG. 21, spool system 804 may be associated with a horizontal plane 879 that intersects each spool in spool system 804. Alternatively, the horizontal configuration of braiding machine 800 can be characterized by the configuration of rotor metals and horn gears (not shown) on top surface 830 (see FIG. 20).

The horizontal configuration of braiding machine 100 and braiding machine 800 may be similar to the horizontal configuration of various kinds of lace braiding or Torchon braiding machines.

FIGS. 23 through 25 illustrate another embodiment of a braiding machine. Specifically, FIG. 23 illustrates an isometric view of an embodiment of a braiding machine 900. FIG. 24 illustrates a side view of an embodiment of braiding machine 900, while FIG. 25 illustrates a cross-sectional side view of an embodiment of braiding machine 900.

Braiding machine 900 may share some features of braiding machine 800, which has been disclosed above and shown in FIGS. 20-22, as well as features of braiding machine 100, which has been disclosed above and shown in FIGS. 1-19. Braiding machine 900 may include a support structure 902 and a spool system 904. In some embodiments, spool system 904 may have a similar or even identical configuration to spool system 104, including any of the various variations described above for spool system 104. In an exemplary embodiment, for example, spool system 904 may be configured as a three-ring system, including an outer ring of rotor metals, an inner ring of rotor metals, and an intermediate ring of horn gears that act to pass spools around the surface of braiding machine 900. Thus, it may be appreciated that spool system 904 may be configured with any of the parts and features discussed above for spool system 104.

In the embodiment of FIGS. 23-25, braiding machine 900 may have a vertical configuration. In particular, spool system 904 of braiding machine 900 may correspond with a vertical plane 989 (see FIG. 24), which is a plane intersecting each of the spools in spool system 904. The vertical configuration may help to reduce the horizontal footprint of braiding machine 900 in a factory or other facility. Moreover, using a vertical configuration for braiding machine 900 may allow for the use of additional provisions used with other vertically oriented braiding machines, such as radial braiding machines.

As seen in FIG. 23, in some embodiments, support structure 902 includes a base portion 910, a front portion 912 and a central fixture 914. Front portion 912 comprises a front surface 930, which may further include a central surface portion 931 and a peripheral surface portion 932. Front portion 912 may also include a sidewall surface 934 that is proximate peripheral surface portion 932. In the exemplary embodiment, front portion 912 has an approximately circular geometry, though in other embodiments, front portion 912 could have any other shape.

Base portion 910 may comprise one or more support beams 920. In some embodiments, base portion 910 comprises individual support beams 920 assembled as a stand. Of course, it may be appreciated that the geometry of base portion 910 could vary in any other manner in other embodiments.

In this embodiment, base portion 910 acts to support front portion 912 and may therefore be formed in a manner so as to support the weight of front portion 912, as well as central fixture 914 and spool system 904, which are attached to front portion 912.

Braiding machine 900 may include central fixture 914. In the exemplary embodiment, central fixture 914 includes one or more legs 940 and a central base 942. Central fixture 914 also includes a dome portion 944. In other embodiments, however, central fixture 914 could have any other geometry. As seen in FIG. 23, dome portion 944 includes an opening 970. Opening 970 is further connected to a central fixture cavity 972, which is best seen in FIG. 25.

Components of support structure could be comprised of any materials. Exemplary materials that could be used include any materials with metals or metal alloys including, but not limited to, steel, iron, steel alloys, and/or iron alloys.

The embodiment of FIGS. 23-25 includes a moveable last system 990, which is depicted schematically in FIGS. 24 and 25. Moveable last system 990 further includes a plurality of lasts 992. Plurality of lasts 992 may be configured to enter braiding machine 900 through a rear side opening 960, which is best seen in FIG. 25. Once inserted through rear side opening 960, plurality of lasts 992 may pass through a central cavity 962 of front portion 912, and through a central fixture cavity 972 of central fixture 914, before finally passing out of opening 970 in dome portion 944. As each last emerged from opening 970, the last may pass through a braiding point such that threads may be braided onto the surface of the last (not shown).

The lasts of plurality of lasts 992 may have any size, geometry, and/or orientation. In the exemplary embodiment, each last of plurality of lasts 992 comprises a three-dimensional contoured last in the shape of a foot (i.e., last member 998 is a footwear last). However, other embodiments could utilize lasts having any other geometry that is configured for forming braided articles with a preconfigured shape.

It may be appreciated that in still other embodiments, a braiding machine could have a vertical configuration and utilize a fixed last, rather than a moving last system. Thus, in another embodiment, braiding machine 900 could be configured to operate with a fixed last, as discussed above and shown in FIGS. 1-3.

It may be appreciated that some embodiments having a vertical configuration could utilize provisions to ensure components stay in the correct place or orientation during operation. For example, some embodiments could include additional provisions to ensure that rotor metals, horn gears, carrier elements and/or spools do not fall off a braiding machine in the vertical orientation. Such provisions may include using various kinds of fasteners or track systems that allow components to move in some directions (e.g., around a ring in a surface of the braiding machine) while restricting motion in others (e.g., motion of elements away from an axial orientation or away from a front surface of the braiding machine). In some embodiments, magnetic components could be used to hold elements adjacent a surface of a braiding machine while allowing for some motion along the same surface.

The exemplary braiding machines discussed herein may be utilized to make various kinds of articles that can be comprised of multiple layers and/or braid patterns. The embodiments could be used to make any of the articles, and operated according to any of the methods, disclosed in Lee, U.S. Patent Publication Number 2017-0035149 (also U.S. patent application Ser. No. 14/820,822, filed on the same day as the current application), titled "Multi-Layered Braided Article and Method of Making", the entirety of which is herein incorporated by reference.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A braiding machine, comprising:

a support structure; and a spool system, comprising:

a first set of spool moving elements arranged in a first ring on the support structure, the first set of spool moving elements comprising a first plurality of rotor metals;

a second set of spool moving elements arranged in a second ring on the support structure, the second set of spool moving elements comprising a plurality of horn gears;

a third set of spool moving elements arranged in a third ring on the support structure, the third set of spool moving elements comprising a second plurality of rotor metals; and a spool with thread, the spool being mounted to a carrier element, wherein the spool mounted to the carrier element can be passed between the first set of spool moving elements and the second set of spool moving elements and wherein the spool mounted to the carrier element can be passed between the third set of spool moving elements and the second set of spool moving elements, and wherein the plurality of horn gears is displaced axially from the first plurality of rotor metals and the second plurality of rotor metals.

2. The braiding machine of claim 1, wherein the second ring is concentrically arranged between the first ring and the third ring, and wherein the plurality of horn gears are positioned in overlapping fashion with the first plurality of rotor metals and the second plurality of rotor metals.

3. The braiding machine of claim 1, wherein the first set of spool moving elements is equal in number to the third set of spool moving elements.

4. The braiding machine of claim 3, wherein the second set of spool moving elements is equal in number to the first set of spool moving elements and the third set of spool moving elements.

5. The braiding machine of claim 1, wherein each of the first plurality of rotor metals comprises a respective concave side, wherein each of the plurality of horn gears comprises a respective slot, and wherein the concave sides of the first plurality of rotor metals have a different diameter than the slots of the plurality of horn gears.

6. The braiding machine of claim 5, wherein each of the third plurality of rotor metals includes a respective concave side, and wherein the concave sides of the third plurality of rotor metals have a different diameter than the slots of the plurality of horn gears.

7. The braiding machine of claim 1, wherein each of the first plurality of rotor metals includes a pair of opposite concave sides, and wherein each of the plurality of horn gears includes four slots.

8. The braiding machine of claim 1, wherein the spool can be passed from a first spool moving element in the first ring to an adjacent second spool moving element in the first ring.

9. The braiding machine of claim 1, wherein the spool can be passed from a first spool moving element in the third ring to an adjacent second spool moving element in the third ring.

10. The braiding machine of claim 1, wherein a spool moving element in the first ring has a geometry that is symmetric about a rotation of 180 degrees.

11. The braiding machine of claim 1, wherein a spool moving element in the second ring has a geometry that is symmetric about a rotation of 90 degrees.

12. A braiding machine, comprising:
- a support structure; and
- a spool system, comprising:
  - a set of rotor metals arranged in a first ring on the support structure;
  - a set of horn gears arranged in a second ring on the support structure; and
  - a spool with thread, the spool being mounted to a carrier element,
- wherein the spool mounted to the carrier element can be passed between the set of rotor metals in the first ring and the set of horn gears in the second ring, and
- wherein the set of horn gears is displaced axially from a surface of the braiding machine a different distance than the set of rotor metals.

13. The braiding machine of claim 12, wherein the set of horn gears and the set of rotor metals are arranged in an overlapping configuration relative to each other, and wherein the set of rotor metals includes a first rotor metal having a first convex side, a first concave side, a second convex side opposite the first convex side and a second concave side opposite the first concave side.

14. The braiding machine of claim 13, wherein the first rotor metal is symmetric about a rotation of 180 degrees.

15. The braiding machine of claim 13, wherein the set of horn gears includes a first horn gear with four slots, and wherein a diameter of each of the four slots is smaller than a diameter of the first and second concave sides of the first rotor metal.

16. The braiding machine of claim 15, wherein the first horn gear is symmetric about a rotation of 90 degrees.

17. The braiding machine of claim 12, wherein the carrier element is held in a gap formed between two adjacent rotor metals of the set of rotor metals while the spool is in the first ring.

18. The braiding machine of claim 12, wherein the carrier element comprises a rotor engaging portion coupled to a rod portion, and wherein the rod portion of the carrier element is held in a slot of a horn gear in the set of horn gears while the spool is in the second ring.

19. The braiding machine of claim 12, wherein the first ring is arranged concentrically with the second ring.

20. A braiding machine, comprising:
- a support structure comprising a top surface; and
- a spool system supported on the top surface, the spool system comprising:
  - a first set of rotor metals arranged in an inner ring on the support structure;
  - a set of horn gears arranged in an intermediate ring on the support structure;
  - a second set of rotor metals arranged in an outer ring on the support structure, wherein a first rotor metal of the first set of rotor metals is displaced from a first horn gear of the set of horn gears axially relative to the top surface; and
  - a spool with thread, the spool being mounted to a carrier element,
- wherein the spool mounted to the carrier element can be passed between the first set of rotor metals and the set of horn gears and wherein the spool mounted to the carrier element can be passed between the second set of rotor metals and the set of horn gears.

21. The braiding machine of claim 20, wherein the inner ring is concentrically arranged within the intermediate ring.

22. The braiding machine of claim 21, wherein the intermediate ring is concentrically arranged within the outer ring.

23. The braiding machine of claim 20, wherein the inner ring, the intermediate ring and the outer ring define a braiding plane of the braiding machine, and wherein the braiding plane is a horizontal plane that is configured to be parallel with a ground surface when the braiding machine is positioned on the ground surface in an orientation for operation.

24. The braiding machine of claim 20, wherein the inner ring, the intermediate ring and the outer ring define a braiding plane of the braiding machine, and wherein the braiding plane is a vertical plane that is configured to intersect a ground surface when the braiding machine is positioned on the ground surface in an orientation for operation.

25. The braiding machine of claim 20, wherein the support structure includes a central fixture located at a center of the inner ring.

26. The braiding machine of claim 25, wherein a last is mounted to the central fixture and held in place on the central fixture when the braiding machine is operated.

27. The braiding machine of claim 25, wherein the central fixture includes an opening sized to receive a last.

28. The braiding machine of claim 20, wherein the first rotor metal of the set of rotor metals includes a concave side, and wherein the first horn gear of the set of horn gears includes a slot, wherein the carrier element comprises a rotor engaging portion coupled to a rod portion, and wherein the concave side is sized to engage the rotor engaging portion and wherein the slot is sized to engage the rod portion.

* * * * *